United States Patent [19]

Sugiura

[11] 4,450,742

[45] May 29, 1984

[54] ELECTRONIC MUSICAL INSTRUMENTS HAVING AUTOMATIC ENSEMBLE FUNCTION BASED ON SCALE MODE

[75] Inventor: Toshio Sugiura, Hamamatsu, Japan

[73] Assignee: Nippon Gakki Seizo Kabushiki Kaisha, Tokyo, Japan

[21] Appl. No.: 332,306

[22] Filed: Dec. 18, 1981

[30] Foreign Application Priority Data

| | | | |
|---|---|---|---|
| Dec. 22, 1980 | [JP] | Japan | 55-180474 |
| Dec. 26, 1980 | [JP] | Japan | 55-183689 |
| Dec. 26, 1980 | [JP] | Japan | 55-183690 |
| Dec. 26, 1980 | [JP] | Japan | 55-183691 |

[51] Int. Cl.[3] ..... G10F 1/00

[52] U.S. Cl. ..... 84/1.03; 84/DIG. 22; 84/1.17; 84/1.24

[58] Field of Search ..... 84/1.01, 1.03, 1.24, 84/1.17, DIG. 22

[56] References Cited

U.S. PATENT DOCUMENTS

| | | | |
|---|---|---|---|
| 4,328,732 | 5/1982 | Takeda et al. | 84/1.03 |
| 4,366,739 | 1/1983 | Delong et al. | 84/1.03 |

*Primary Examiner*—Forester W. Isen

*Attorney, Agent, or Firm*—Spensley, Horn, Jubas & Lubitz

[57] ABSTRACT

An electronic musical instrument comprises a keyboard for performing a melody, a chord performing means, tonality designating means for designating a tonality of a music to be performed, melody mode judging means for judging the melody mode of the music based on an accompaniment chord, ensemble note data forming means for forming ensemble note data in accordance with the judged melody note and depressed melody keys of the keyboard; and musical tone forming means for forming musical tones corresponding to the ensemble note data and musical tones corresponding to the melody keys.

21 Claims, 9 Drawing Figures

ELECTRONIC MUSICAL INSTRUMENTS HAVING AUTOMATIC ENSEMBLE FUNCTION BASED ON SCALE MODE

BACKGROUND OF THE INVENTION

This invention relates to an electronic musical instrument having automatic ensemble function and particularly an electronic musical instrument having automatic ensemble function and particularly an electronic musical instrument for automatically producing an ensemble notes suitable for melody notes played.

Among various musical performances, may be mentioned an ensemble note performance, that is a performance wherein a plurality of notes are simultaneously performed with a melody performance. In the ensemble note performance one or a plurality of notes having predetermined note-interval relations are performed simultaneously so as to enhance the melody feeling. Although the musical effect of such ensemble note performance is large, all the persons can not always enjoy the ensemble note performance since it requires a relatively high performance skill. For this reason, it has been desired to provide an electronic musical instrument that can automatically perform the ensemble note performance, but prior art electronic musical instruments are difficult to provide favorable ensemble note performance effects.

An electronic musical instrument that can provide musical effect resembling the ensemble note performance is disclosed in U.S. Pat. No. 3,929,051 which is constructed to automatically add a harmonized note to a melody note to enrich a melody note performance. More particulary, it is constructed to produce a plurality of notes (chord) corresponding to actually depressed keys of an accompaniment keyboard within the range of one octave below the melody note on the melody keyboard. With this construction, however, since the same note as the chord is merely added to the melody note, it has been impossible to obtain a favorable ensemble note performance effect. Moreover, since the number of the depressed keys of the accompaniment keyboard is not always the same the number of the added notes is not constant which is also unfavorable from the standpoint of musical feeling. Especially, it has been impossible to perform a typical ensemble note performance in which a single note having a predetermined interval difference with respect to a melody note is added to the low tone side of the melody note.

An electronic musical instrument intended to provide an ideal ensemble note performance is disclosed in prior U.S. Pat. application Ser. No. 220,099. This electronic musical instrument is constructed to designate beforehand the musical tonality to be performed to select a note having a predetermined interval relation with respect to a melody note from among the notes in a scale of the designated tonality and to add the selected note to the melody note as an ensemble note.

In this manner, where an ensemble note having a predetermined interval relation with respect to a melody note is added by taking into consideration the tonality, it is possible to add a favorable ensemble note. More particularly in order to provide a definite interval feeling it is important to distinguish the lengths of the intervals between the melody note and the ensemble note by taking into consideration a given tonality and the degree of the melody note in the scale of that tonality, etc., and in the aforementioned prior patent application such point has been taken into consideration. This patent application suggests that not only a single ensemble note but also a plurality of ensemble notes are to be added to a melody note. More particularly, according to the same manner of adding a single ensemble note, a plurality of ensemble notes having different intervals from the melody note are added thereto. However, a plurality of ensemble notes added in a manner described above, the probability that causes unconsonance between the ensemble note and an accompaniment chord becomes high. For example, where an ensemble note having a third interval separation from the melody tone and an ensemble note having a 6th interval are added simultaneously three tones consisting of the melody note and two ensemble notes and the accompaniment chord tones (for example, three tones) are produced with the same tone volume and where the accompaniment chord is not harmonized with the harmonies of the melody note and of the ensemble note, discordant feeling becomes large.

In the aforementioned prior patent application, it was tried to add musically reasonable ensemble notes by modifying the condition of selection of the notes to be added as ensemble notes in accordance with whether the accompaniment chord consists of diatonic notes in the designated tonality or nondiatonic notes. In recent years, however, it was found that where the condition of selection of the ensemble notes is made to depend upon only the tonality and the diatonic nature of the accompaniment chord the resulting musical tones become unnatural. Furthermore, in that patent application, various exceptional considerations are made by taking into such musical theories as a modulation, a passing note, an appoggiatura, a suspension, etc. but failed to provide an ensemble note performance without imparting any appreciable unnaturality. To make such exceptional processings it is necessary to add a number of processing circuits.

In all cases described above, a special device is necessary to have a desired tone color distribution between the depressed key note (that is the melody note) and the ensemble note added thereto. More particularly, according to the prior art method, the key data of a note to be automatically added is applied to a musical tone forming circuit for an upper keyboard together with a key data of an upper keyboard depressed note (corresponding to a melody note) for simultaneously forming a musical tone having the same tone color, or the ensemble note alone is used to form a musical tone independently of a melody note with a musical tone forming circuit exclusively used for the ensemble note. Accordingly, the types of combinations of the melody note and the ensemble note are limited thus preventing ensemble note performances over a wide range.

SUMMARY OF THE INVENTION

Accordingly, the principal object of this invention is to provide a novel electronic musical instrument capable of automatically performing an ensemble note free from musical unnaturality.

Another object of this invention is to provide an electronic musical instrument capable of adding a plurality of ensemble notes without accompanying discordant feeling.

Still another object of this invention is to provide a novel electronic musical instrument capable of freely changing the tone color sharing among depressed key notes (usually melody notes) and ensemble notes added thereto, thereby increasing the freedom of the ensemble note performance.

Generally speaking, a desirable ensemble note performance can be realized by adding to a melody note an ensemble note having a substantially constant interval difference therefrom. But in a case where the melodic interval of the melody notes (the interval between the present note and a note immediately before) is large, if the performer tries to add the ensemble note by merely following such melodic move, the melodic interval of the ensemble notes would also become large, thus causing unnatural feeling. In such a case, it is advantageous to make smooth the melodic move of the ensemble notes by suppressing the melodic interval between the ensemble notes.

A further object of this invention is to provide an electronic musical instrument capable of adding ensemble notes without causing an unnatural feeling even where the melodic interval of melody notes is large.

Above described objects can be accomplished by introducing a scale mode or melody mode known in the art into the ensemble note performance so as to automatically judge whether the musical phrase now being performed belongs to which one of the melody modes, thereby adding ensemble notes suitable for each melody mode to depressed key notes (usually, melody notes).

As is clear from the musical theory a scale mode means a manner of alignment of various notes about with respect to a reference note, that is an order of arrangement of whole-tone/semi-tone intervals in the scale. As ordinary 7-note scales (do, re, mi, fa, so la, ti) there are 7 types of arrangements, respectively designated as Ionian mode, Dorian mode, Phrygian mode, Lydian mode, Mixolydian mode, Aeolian mode and Locrian mode. Representing the scale arrangements of the respective modes in terms of syllable names, the Ionian includes "do, re, mi, fa, so, la and ti", the Dorian includes "re, mi, fa, so, la, ti and do", the Phrygian includes "mi, fa, so, la, ti, do and re", the Lydian includes "fa, so, la, ti, do, re and mi", the Mixolydian includes "so, la, ti, do, re, mi and fa", the Aeolian includes "la, ti, do, re, mi, fa and so" and the Locrian includes "ti, do, re, mi, fa, so and la".

As above described, in respective melody modes, the alignment manners of whole-tone/semi-tone of the respective scale notes with respect to the prime note are different so that as is well known, the bright and dark of a music become different dependent upon the scale mode used for the music. The Lydian mode is the brightest mode, followed by the Ionian, Mixolydian and Dorian in the order mentioned. The Dorian mode is at the center of the brightness and darkness in the order and the darkness increases in the order of Aeolian, Phrygian and Locrian. In the course of composition it is not necessary to use a single scale mode throughout the work piece of music, and it is possible to use any effective modes in accordance with the degree of tension feeling through the music. For this reason, it is generally difficult to specify the scale mode utilized in the flow of a music but it should be considered that the mode will vary suitably in the same music.

When adding a suitably harmonized ensemble note to a melody note (or a melody flow) the ensemble note must be suitable for respective modes, because the scale mode alone is an element that characterizes the music phrase. For this reason, addition of an ensemble note that is most adequate for a specific melody note results in an ensemble note performance free from any musical unnaturalness.

Judgement of the melody note is made according to the performed note (usually the accompaniment chord) and the tonality formed by the depressed key note (usually the melody note) to which an ensemble note is to be added. The chords in respective modes are formed within the range of a diatonic scale, and there is a distinct relationship between the chord elements (constituents) and the scale mode. Especially in the primary chords, it is well known in the art that each of them contains scale notes characterizing the essential feature of the modes, so that it is rational to judge the modes based on the accompaniment chords. The accompaniment chord alone, that is an absolute chord formed by depressed keys (a chord specified by a root note and the type of chord such as major or minor) is not sufficient to judge the mode and it is necessary to also take into consideration the position of the prime note on the scale. For this reason, the scale mode is judged based on both the tonality designated prior to the performance (or designated during performance) and the accompaniment chord. To this end, a table may be used which prestores scale modes, corresponding to all combinations of the tonalities and the absolute chords, but with such measure the table must have a large memory capacity. For this reason, according to one embodiment of this invention to be described later, there is provided converting means which respectively converts absolute chord names into relative chord names (a chord representation in which the root note thereof is expressed in degrees with respect to the prime note of the designated tonalities by taking the note name corresponding to the prime note as 1st degree) according to the prime note of the tonality, so as to judge the scale mode from the relative chord names. Then the table utilized to judge the scale mode based on the absolute chord can be simplified.

Further, according to this invention, based on the scale mode judged in a manner described above and a melody note produced by presently depressed key, a note to be added to the melody note is selected. To this end, although it is possible to prepare suitable ensemble notes corresponding to various tone pitches of the melody notes for respective scale modes so that the ensemble notes should be selected in accordance with the discriminated scale mode and the absolute pitch of the note of the presently depressed key, such measure increases the size of the instrument. As a consequence, according to one embodiment of this invention, data (duet interval data) representing intervals necessary to obtain suitable ensemble notes (or duet notes) for respective scale notes of various scale modes are prepared beforehand, so as to select interval data based on the relative note pitch of a melody note, that is a relative note, and the absolute note pitch of the melody note is shifted by an interval corresponding to the interval data, and the melody note thus shifted is determined as the tone pitch of the ensemble note to be added to the melody note. The relative note of the melody note can be obtained by determining the interval of the melody note relative to the root note by taking the root note of the accompaniment chord as one degree. As a result of a musical analysis, it was found that the root note of the accompaniment chord can be treated as the 1st degree note of the scale mode at that time. This means that the degree of a melody note with reference to the root note of an accompaniment chord, that is the relative note corresponds to the degree of the melody note with reference to the scale note of the 1st degree of the scale mode at that time, that is the interval between the melody note and the prime note in the scale of that mode. Consequently, it is possible to form an adequate ensemble note by using the relative note of a melody note as the data that specifies the interval of the scale note in that melody note for selecting the duet interval data corresponding to that scale note.

For the purpose of adding a plurality of ensemble notes without causing discordant feeling, according to one embodiment of this invention, there is provided an electronic musical instrument comprising a keyboard, accompaniment tone performing means, means for forming a first ensemble note having a predetermined interval with regard to a note of a depressed key of the keyboard, means for forming as a second ensemble note, a note having the same note name as that of either one of the tones performed by the accompaniment tone performing means and having a predetermined interval relation with respect to the first ensemble note, and means for producing the depressed key note as a musical tone together with the first and second ensemble notes. Since the second ensemble note added to the first ensemble note has the same note name as that of any one of the accompaniment tones it is possible to prevent discordant feeling with respect to the accompaniment tone.

Furthermore, for the purpose of preventing an unnatural feeling caused by a large variation in the melodic interval of melody notes (a big step of change in note pitch), there is provided an electronic musical instrument comprising a keyboard, ensemble note data forming means, for forming data showing either one of a plurality of ensemble notes respectively spaced from the notes of the depressed keys of the keyboard by a predetermined note interval, ensemble note interval control means which controls the selection of the ensemble data forming means in response to a melodic interval variation of melody notes of the depressed key notes, and musical tone forming means for forming a musical tone corresponding to the ensemble note data formed by the ensemble data forming means and a musical tone corresponding to the depressed key note. This electronic musical instrument enables the automatic switching of the interval degree of the ensemble note with respect to the depressed key note, so that it is possible to limit within a certain extent the melodic interval of the ensemble notes when the melodic interval of the depressed-key notes (melody notes) is large, thus making smooth the melodic motion of the ensemble notes.

In one embodiment, the ensemble note data forming means comprises means for forming data representing an ensemble note in either one of the modes of two types of the modes. Advantageously, the interval mode comprises a 3rd interval mode that forms an ensemble note spaced apart by 3 degrees from the melody note, and a 6th interval mode that forms an ensemble note spaced apart by 6 degrees. Normally, the duet note interval control means selects a 3rd mode but switches to the 6th mode when the melodic interval of the melody notes changes toward the higher tone side by more than predetermined interval (for example more than 6 degrees or more) and then switches back to the third mode when the melodic interval of the melody note varies thereafter in the opposite direction (that is toward the lower tone side) by a certain extent (for example, by a whole tone or more). The melodic interval of the melody notes can readily be determined by comparing the melody note precedingly produced with the melody note now being produced. Since, the ensemble note is generally added to the lower side of the melody note, switching to the 6th mode is effected on a condition in which the melody note movement toward the higher tone side by more than predetermined interval whereas in case the ensemble note is added to the higher tone side of the melody note, the mode is switched to the 6th mode when the melody note movement is toward the lower tone side by more than predetermined degrees.

In a preferred embodiment, there are provided chord performing means (for example, a keyboard used independently of the melody performance) and tonality designation means so that an ensemble note is performance by a note having a tone pitch spaced apart from the melody note by an interval determined by the designated tonality, the played chord, the played melody note and the interval mode.

In this case, in view of the musical theory, it is advantageous to judge the scale mode (do not confuse with the ensemble note interval mode) of a music phrase now being performed based on the designated tonality and the chord thereby forming an ensemble note adequate for the judged scale mode.

According to one aspect of this invention there is provided an electronic musical instrument having an automatic ensemble note function based on a scale mode, comprising a keyboard for performing a melody, chord performing means, tonality designating means for designating a tonality of a music to be formed, scale mode judging means for judging the scale mode of the music based on an accompaniment chord, ensemble note data forming means for forming ensemble note data in accordance with the judged scale mode and depressed melody keys of the keyboard, and musical tone forming means for forming a musical tone corresponding to the ensemble note data and a musical tone corresponding to the melody keys.

According to another aspect of this invention, there is provided an electronic musical instrument having an automatic ensemble note function based on a scale mode, comprising a keyboard, accompaniment note performing means, means for forming a first ensemble note having a predetermined note interval difference with respect to a note of a depressed key of the keyboard, means for forming a second ensemble note having the same note name as that of either one of the notes performed by the accompaniment note performing means and having a predetermined note interval relation with respect to the first ensemble note, the first ensemble note forming means controlling the note interval of the first ensemble note of the depressed key note in accordance with a chord performed by the accompaniment note performing means whereby producing, as a musical tone, the first and second ensemble notes together with the depressed key note.

According to still another aspect of this invention, there is provided an electronic musical instrument having an automatic ensemble note function based on a scale mode, comprising a keyboard for performing a melody, means for detecting a melody mode interval variation caused by successive depression of melody keys of the keyboard, means for forming ensemble note data spaced from melody key notes by a predetermined note interval determined by an output of the detecting means, and means for forming musical tones including a musical tone corresponding to an output of the ensemble note data forming means, and another musical tone corresponding to the melody keys.

DESCRIPTION OF THE PREFERRED EMBODIMENT

A preferred embodiment of this invention will now be described in detail with reference to the accompanying drawings.

It is assumed now that the electronic musical instrument of this embodiment is provided with at least two keyboards or keyboard ranges which are operated individually. One keyboard or keyboard range is used for the performance of notes (usually melody notes) to which ensemble notes are to be added, while the other keyboard or keyboard range is used for the performance of notes (usually accompaniment chord) accompanying the depressed melody notes. The depressed key notes of respective keyboards or keyboard ranges are imparted with switchable tone colors and then produced as musical tones in the same manner as in a conventional electronic musical instrument. Further, in addition to the depressed key notes, that is melody notes, of one keyboard or keyboard range, ensemble notes added thereto are automatically produced. The ensemble note to be added to the melody note may comprise a single note or a plurality of notes. In the following description, an ensemble note formed in accordance with this invention, that is by taking into consideration a musical scale or melody mode is termed a "duet" note, whereas another ensemble note to be further added to the duet note is termed a "trio" note.

Figures 1, 3:
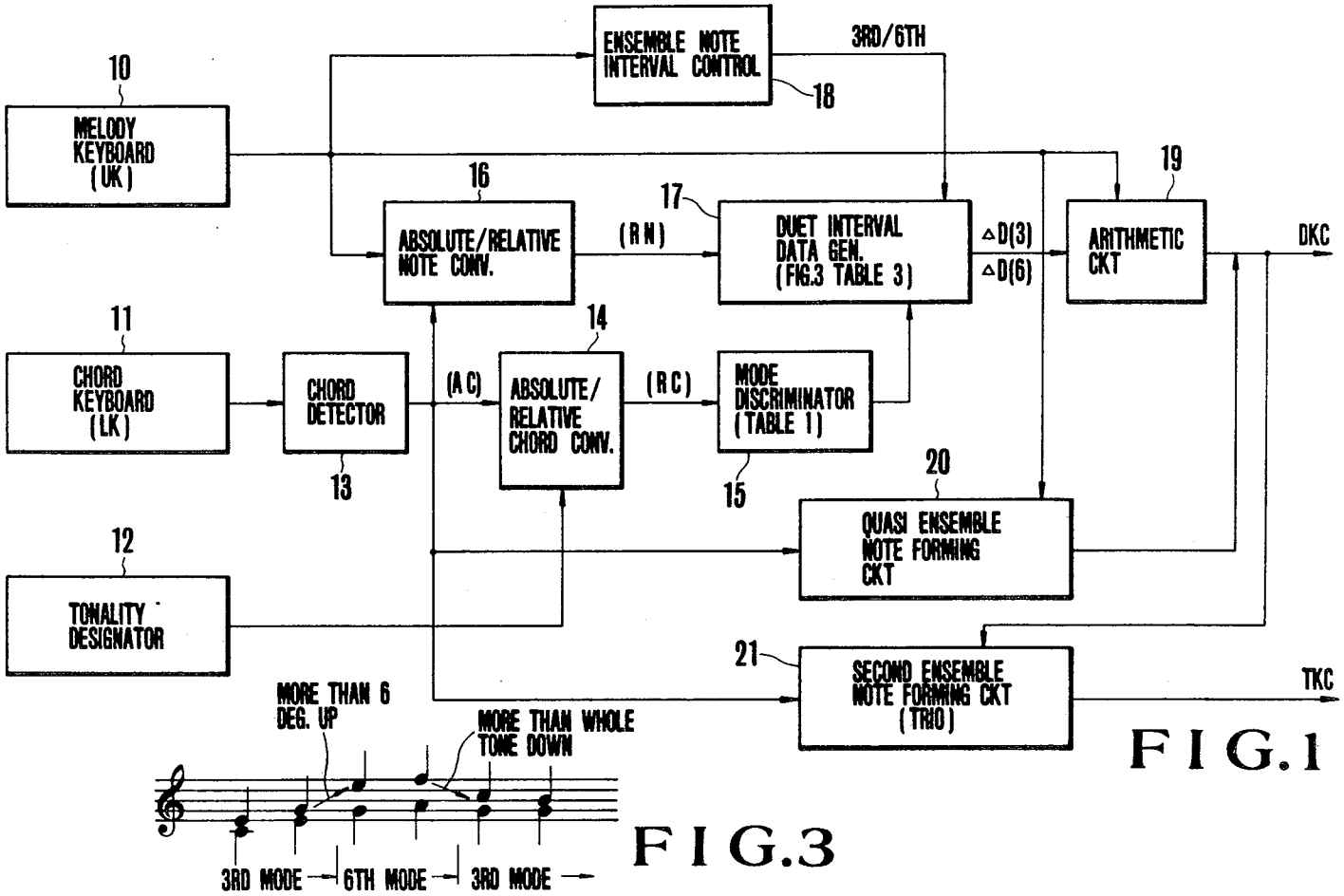
FIG. 1 is a block diagram showing the principle of one embodiment of this invention.
FIG. 3 shows a music sconeshowing one example of a performance in which the degree mode for an ensemble note is switched.

In FIG. 1, a melody keyboard (or a keyboard range) 10 comprises an upper keyboard, for example, while a chord keyboard (or a keyboard range) 11 comprises a lower keyboard. A tonality designator 12 is provided for designating a musical tonality to be performed and made up of switches or any other input means. A chord detector 13 is provided for detecting the accompaniment chord produced by the chord keyboard 11. The chord detected thereby is a so-called absolute chord (AC) and consists of a root note name and a type name from among various types of chords (major, minor, seventh, etc.). The way of producing an accompaniment chord on the chord keyboard 11 is not limited to a way wherein all keys necessary to designate the chord constituting notesare depressed, but any other suitable way may also be used including a way wherein only a key corresponding to a root note is depressed and the type of the chord is designated by a suitable method and a method wherein a chord once formed is stored so that even after the key depressed for producing the chord has been released, the effect of the depressed key is maintained.

Furthermore, an absolute/relative chord converter 14 is provided for converting the absolute cord representation detected by the chord detector 13 into a relative chord (RC) representation with reference to the prime note of the tonality designated by the tonality designator. In other words, the root note data of the absolute chord (A C) representation is converted into the degree (or note interval) data with reference to the prime note of the designated tonality scale. Thus, this means that the relative chord (R C) represents what degree of the chord in the scale of the designated tonality. A mode discriminator 15 judges which one of the melody modes the music phrase now being performed bears with reference to the relative chord (R C). The judgement is made according to the following.

TABLE I

Table 1 (melody mode discriminating table)

| One Example of (A C) | Input | Output | One Example of (A C) | Input | Output |
|---|---|---|---|---|---|
| in the case of C tonality | relative chord (R C) | scale mode | in the case of C tonality | relative chord (R C) | scale mode |
| C | I | Ionia | F# | IV# | mode, |
| C7 | I7 | Mixo-lydia* | F#7 | IV#7 | indefinite, #1 |
| Cm | Im | mode, in- | F#m | IV#m | mode, |
| Cm7 | Im7 | definite, #2 | F#m7 | IV#m7 | indefinite, #2 |
| C# | I# | mode, in- | G | V | Mixolydia |
| C#7 | I#7 | definite, #1 | G7 | V7 | " |
| C#m | I#m | mode, in- | Gm | Vm | mode, |
| C#m7 | I#m7 | definite, #2 | Gm7 | Vm7 | indefinite, #2 |
| D | II | mode, in- | G# | V# | mode, |
| | | definite, #1 | | | indefinite, #1 |
| D7 | II7 | Mixo-lydia* | C#7 | V#7 | |
| Dm | IIm | Doria | C#m | V#m | mode, |
| Dm7 | IIm7 | | C#m7 | V#m7 | indefinite, #2 |
| D# | II# | Lydia* | A | VI | mode, indefinite, #1 |
| D#7 | II#7 | mode, in- | A7 | VI7 | minor |
| | | definite, #1 | | | Mixolydia* |
| D#m | II#m | mode, in- | Am | VIm | Aeolia |
| D#m7 | II#m7 | definite, #2 | Am7 | VIm7 | |
| E | III | Ionia* | A# | VI# | Lydia* |
| E7 | III7 | minor-Mixo-lydia* | A#7 | VI#7 | mode, indefinite, #1 |
| Em | IIIm | Phrygia | A#m | VI#m | mode, |
| Em7 | IIIm7 | " | A#m7 | VI#m7 | indefinite, #2 |
| F | IV | Lydia | B | VII | mode, |
| F7 | IV7 | Mixo-lydia* | | | indefinite, #1 |
| | | | B7 | VII7 | minor Mixolydia* |
| Fm | IVm | mode, in- | Bm | VIIm | mode, |

TABLE I-continued

| Table 1 (melody mode discriminating table) | | | | | |
|---|---|---|---|---|---|
| One Example of (A C) | Input | Output | One Example of (A C) | Input | Output |
| Vm7 | IVm7 | definite, #2 | Bm7 | VIIm7 | indefinite, #2 |
| | | | Bm7-5 | VIIm7-5 | Locria |

In this table, in the input column are shown the relative chords (R C) and in the output columns are shown the names of the scale modes discriminated in accordance with the relative chords. Regarding the relative chords, the first Roman letters I, II, III, IV . . . VII show the degrees of the root notes with reference to the prime note of the tonality, and the subscripts 7, m and m7 represent the seventh chord, the minor chord and the minor seventh chord respectively. The root note degrees of the semitone are represented by adding a symbol ♯ (sharp) to the diatonic scale notes which are a semitone lower than the intended notes, that is I♯, II♯. . . . A symbol VIIm7-5 represents an alternate minor seventh chord established on the 7th musical scale note, i.e. a minor seventh chord whose root note is the 7th degree note in the scale and whose 5th degree note is blatted. In the column of "one example of (A C)" are shown chords for the C tonality as one set of examples of the absolute chords (A C) for the respective relative chords (R C).

As a basic rule, the scale mode is judged such that when an diatonic chord (that is a chord consisting of primary chord elements that characterize best the feature of that scale mode) whose root note is the prime note of the scale mode appears, it is judged that this scale mode is being adopted in that musical phrase. Based on this rule, are judged Ionian, Dorian, Phrygian, Lydian, Mixolydian, Aeolian and Locrian (shown in Table I) corresponding to relative chord names I, IIm, IIm7, IIIm, IIIm7, IV, V, V7, VIm, VIm7 and VIIm7-5, respectively.

There are two reasons for the presence of indefinite mode (scale mode, indefinite). The first reason corresponds to a case wherein it is impossible to judge the scale mode because the chord is not a diatonic chord (that is a chord containing a chromatic scale note or notes), and the second reason corresponds to a case wherein the chord is used according to more than two scale modes at the same probability, thus making it difficult to determine which melody mode. In this embodiment, where the mode is indefinite or not clear, the ensemble note is formed according to the major/minor distinction of the accompaniment chord at that time (including a major third or a minor third interval). Accordingly, the mode, indefinite #1 and #2 are discriminated according to the major/minor distinction of the accompaniment chord. More particularly, by deeming the indefinite modes #1 and #2 as provisional melodies the specific ensemble notes are added thereto.

The scale modes attached with a symbol * are scale modes that can be discriminated by deeming them as modulation. The input chords (I7, II7, II♯, III . . . ) corresponding to the outputs with symbols * marks are chords not used ordinarily at the tonality now being designated, but are used actually at other tonalities. For this reason where these chords are used, it is judged that a modulation occurred so as to judge the modulated scale mode. Thus, when modulated, the relative chord I7 can be deemed a relative chord of V7 so as to judge a Mixolydia comprising this V7 as the primary chord according to I7. More particularly, the absolute chord C7 is a primary chord (one of the three primary chords) of the F tonality, whereas in the C tonality the absolute chord C7 is not a primary chord. Consequently, in the C tonality when the C7 chord is performed and a relative chord I7 is detected, it is detected as a dominant 7th chord in the F tonality, thus judging that the present melody mode is a Mixolydia corresponding to the dominant 7th chord. In this manner, the scale modes marked with * shown in Table I descriminate the modulated melody modes. Let us describe the base of other symbols * by taking C tonality as an example. The relative chord II7 (D7 of the absolute chord) is considered to be a modulation to G tonality. After this modulation, it becomes the V7 chord so that it is judged as a Mixolydia. When modulated to A♯ tonality, II♯ (D♯) is deemed as IV, thus judged as a Lydia. When modulated to E tonality, III (E) is deemed as I, thus judged as an Ionia. Similarly, when modulated to A♯ tonality, IV7 (F7) is deemed as V7, thus judged as a Mixolydia. When modulated to F tonality, VI♯ (A♯) is deemed as IV, thus judged as a Lydia.

It is now presumed that a modulation to a minor tonality is judged as a minor Mixolydia. While the minor Mixolydia has the same scale arrangement as the Phrygia, where it is deemed that the minor Mixolydia has been modulated to a minor tonality, it is advantageous to form a special ensemble (different from Phyrygia) by using a so-called minor Mixolydia by modifying a Mixolydia to have a minor musical scale instead of a Phyrygia for the purpose of giving a feeling of a minor musical scale. Taking the C tonality as an example, where the relative chord is III7 (E7 of the absolute chord) it is deemed as a modulation to the A minor tonality. When this absolute chord E7 is in an A minor tonality it becomes a V7 chord, it is judged as a minor Mixolydia. Where the relative chord is VI7 (A7 of the absolute chord), it is deemed as a modulation to a D minor tonality, and when modulated it becomes V7, so that it is judged as a minor Mixolydia. On the other hand, when the relative chord is VII7 (B7 of the absolute chord) it is deemed as the modulation to the E minor tonality and when modulated it becomes V7 whereby it is judged as a minor Mixolydia.

In the absolute/relative note converter 16, the relative note (R N) name of the melody note (in absolute name) of the depressed key of the keyboard 10 is determined, which represents the degree of the note name of the melody note where the root note of the chord detected by the chord detector 13 is taken as 1st degree. There are 12 kinds of relative note (R N) ranging between the first degree and major 7th degree at an interval of a semitone. These kinds are first (1°), minor second (♭2°), major second (2°), minor third (♭3°), major third (3°), perfect fourth (4°), diminished minus fifth (♭5°), perfect fifth (5°), minor sixth (♭6°), major sixth (6°), minor seventh (♭7°) and major seventh (7°).

A duet interval data generator 17 is provided for producing a duet interval data (ensemble interval data) suitable for a scale degree shown by a relative note (R N) corresponding to a melody mode discriminated by the mode descriminator 15. The duet interval data generator 17 produces either one of a duet interval data ΔD(3) for an ensemble in a 3rd-interval mode (usually an ensemble by a 3rd interval below the melody note) and a duet interval data ΔD(6) for an ensemble in a 6th-interval mode (usually an ensemble by a 6th interval below the melody note). This is made for the purpose of controlling switching of the ensemble degree modes to be described as follows.

In this embodiment, as a rule a duet, that is an ensemble note utilizes a scale note which is a third lower than a melody note. Where a melody note goes up from the preceding note by more than the predetermined degrees, it is not preferrable that the ensemble note rises rapidly following thereto, so that it is advantageous to make small the rise in the ensemble note for making smooth the melody progression. For this reason, where the melody note rises above the preceding note more than the predetermined degrees an ensemble note to be added to the melody note is switched to a note which is a 6th lower than the melody note to make melody progression of the ensemble smooth. Thereafter, when the melody note goes down from the preceding note by more than the predetermined degrees, an ensemble note to be added to that melody note is switched to a note which is a 3rd below. The control of such switching is effected by an ensemble note interval control device 18. The expression 3rd below or 6th below does not always means accurately a 3rd interval below or a 6th interval below. Accordingly a mode which frequently becomes a 3rd below" is termed a 3rd mode, and a mode which frequently becomes "a 6th below" is termed a 6th mode.

Usually, the ensemble note interval control device designates a third mode, so that when determining the intervals of preceding and present melody notes, if it is detected that the present melody note is higher than the preceding note by a 6th or more, the mode is switched to the 6th mode. Thereafter, when it is detected that the present melody note has lowered by a major second or more from the preceding melody note, the mode is returned to the 3rd mode. The reason that the interval by which the mode is returned to the 3rd mode is selected to be the major second that is the whole note or more lies in that lowering of 2 degrees that is a semitone often results in a temporary lowering caused by an appoggiatura or a suspension and that the restored mode immediately returns to the orignal mode. Where the mode designated by the ensemble note interval control device 18 is a third mode, the duet interval data generator 17 produces a duet interval data ΔD(3) for the 3rd mode, whereas when the designated mode is a 6th mode the generator 17 produces a duet interval data ΔD(6).

The duet interval data ΔD(3) and ΔD(6) show that notes apart from the melody note by predetermined degrees should be generated an ensemble note (duet note). Even when the degree is the same, as it is necessary to discriminate a semitone from a whole note, data ΔD(3) and ΔD(6) are expressed in terms of data representing the number of semitone contained in an interval between an ensemble note to be produced and a melody note. One example of expressing data ΔD(3) and ΔD(6) is shown in the following Table II in which 1°, ♭2°, 2° . . . ♭7°, 7° respectively represent the first, minor second, major second, degrees . . . , minor 7th and major 7th.

An arithmetic operation circuit 19 is provided for producing data DKC showing the pitch of an ensemble note (duet) by shifting the pitch of a melody note by an interval designated by the duet interval data ΔD(3) or ΔD(6).

Figure 2:
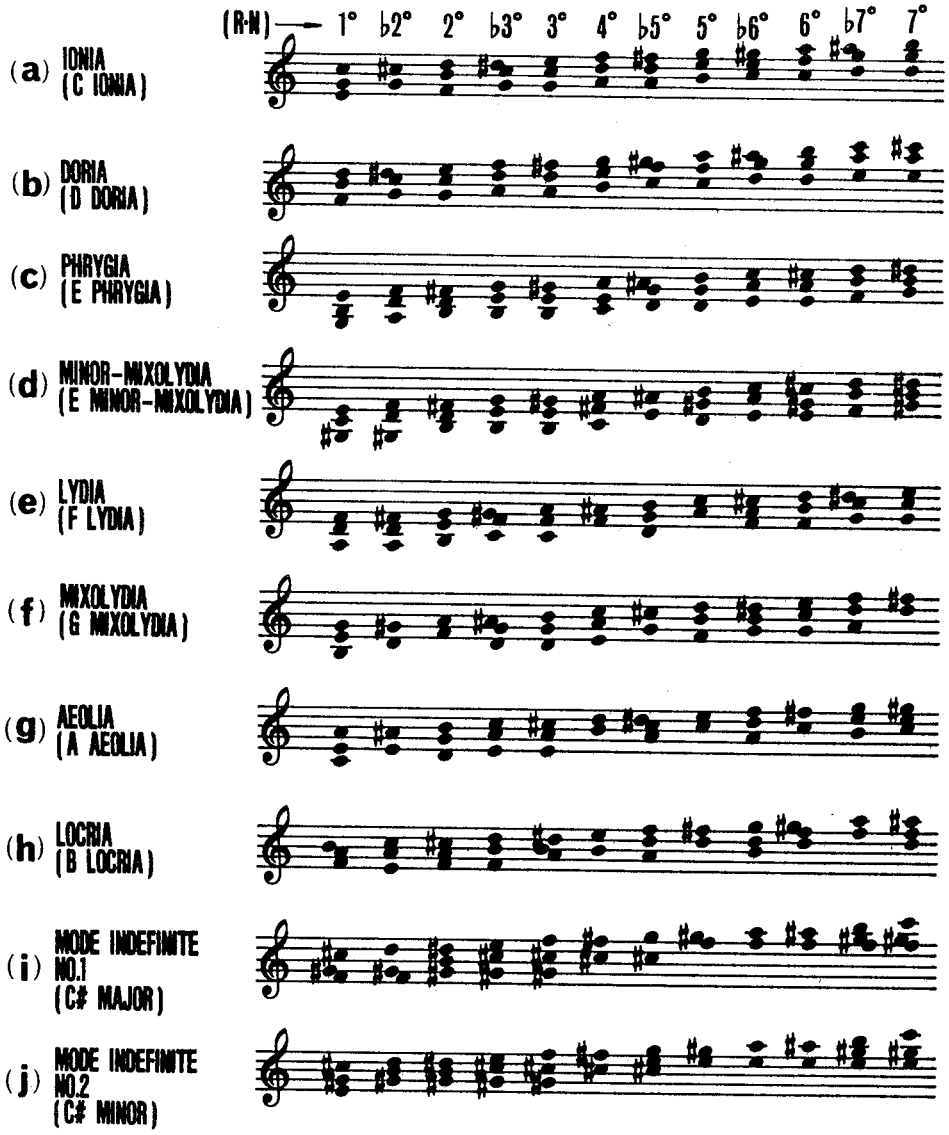
FIG. 2 shows musics including ensemble notes preferred for 3rd mode and 6th mode for various scale notes including a semitone.

One example of the ensemble note (duet) of the third or 6th mode suitable for respective musical scales is shown in FIG. 2 which shows the most preferable ensemble notes obtained by analyzing a plurality of musics. FIGS. 2*a* through 2*j* shows musical note scale of Ionia, Doria, Phrygia, minor Mixolydia, Lydia, Mixolydia, Aeolia, Locria, indefinite mode #1, and indefinite mode #2, respectively. In the case of a C tonality, melody modes are called respectively as C Ionia, D Doria, E Phrygia, E minor Mixolydia, F Lydia, G Mixolydia, A Aeolia and B Locria by adding the note mark of one degree note. In this embodiment also, the indefinite mode (melody mode) is deemed as a musical scale for adding a predetermined ensemble note corresponding to each musical scale note. In this case, the not clear mode #1 is deemed as a major note scale, the indefinite mode #2 is deemed as a minor note scale, and the root note of the chord in this case is deemed as a first note of the musical scale. FIGS. 2*i* and 2*j* show the musical scales corresponding to a chord including a note name C♯ as the root note.

In FIG. 2 the highest pitch note among 3 (rarely 2) notes which are produced simultaneously represents a melody note. Expressions 1° through 7° (first through major 7th according to the relative note (R N) of the melody note, that is degrees of the musical scales are written on the upper sides of respective notes. The note of an intermediate tone shows an ensemble note (duet) of the third mode whereas the note of the lowest tone represents the ensemble note (duet) of the 6th mode. Where there are only two notes, it means that the third and the 6th mode ensemble notes are the same.

The basic rule of adding an ensemble note is to select a note as an ensemble note 3 or 6 degrees lower than a melody note among the whole scale notes of the melody notes. For instance, according to the Ionia melody mode shown in FIG. 2*a*, this rule is applied to a melody note whose relative notes are major second (2°), major third (3°), fourth (4°), perfect fifth (5°), major 6th (6°) and major 7th (7°). More particularly the note name D (syllable name re), that is the scale note of the major second of C (Ionia), a note name B (syllable name si), that is the whole scale note is selected as the ensemble note of the third mode, and a note name F (syllable name fa), that is a whole scale note a 6th lower than the C (major 6th below) is selected as the ensemble note of the 6th mode. where the note name E (syllable name mi), that is the scale note of the major third (3°) of the C Ionia is a melody note, the note name C (syllable name doh), that is the whole scale note a third lower (major third below) is selected as the ensemble note of the third mode, while a note name G (syllable so), that is a whole scale note a 6th lower than the C major that is selected as the ensemble of the 6th mode.

TABLE II

| Interval between Melody Notes and Ensembled Note | 1° | b2° | 2° | b3° | 3° | 4° | b5° | 5° | b6° | 6° | b7° | 7° |
|---|---|---|---|---|---|---|---|---|---|---|---|---|
| Mode of Representation (number of semitones) | 0 | 1 | 2 | 3 | 4 | 5 | 6 | 7 | 8 | 9 | 10 | 11 |

As an exception of the basic rule described above, at sometimes the ensemble note is selected under the following considerations.

EXCEPTION 1

Where a melody note is a chord constituting note and where a note 3rd or 6th lower than it is not a chord constituting note, a chord constituting note at an interval about 3rd or 6th lower is selected as an ensemble note for the purpose of giving a feeling of a chord. For example, in the Ionia melody mode shown in FIG. *2a*, this exception is applied for a melody note whose relative note equals the first (1°). More particularly suppose now that where a C major chord is performed at the C tonality and a C Ionian scale mode is judged. Then, when the note name C (syllable name do), that is the sale note of the first (1°) at that C Ionia is a melody note, as shown in FIG. *2a*, instead of a note name A a third lower, a note name G which is one of the chord constituting tones is selected as the ensemble note of the third mode. This note name G has an interval a 4th lower than the note name C but it is selected as the third mode ensemble note for the purpose of giving a feeling of a chord. The relative note (R N) represents the number of degrees of the melody note with respect to the root note of the accompaniment note at that time, whereas as shown in Table I, the root note of the chord corresponds to the first note of a musical scale at each melody mode. Accordingly, it is possible to know beforehand that respective chord constituting notes of the chords corresponding to respective melody modes correspond to which one of the scale tones of what degrees at these melody modes. Accordingly, when applying the exception 1 any troublesome processing of scanning of the chord constituting notes is not required. This exception 1 (also the other exceptions to be described later is not applicable to all cases which satisfy the conditions necessary for applying the basic rule but is applicable to specific cases by considering a musicality. For example, as shown in FIG. *2b*, the first note of the Doria (the melody note having a note name D at the time of D Doria) is the root note of the accompaniment chord (a Dm chord at the time of the D Doria) at that time, the ensemble note of the third mode thereof is not a chord constituting note (note name A, that is the 5th note of a D minor chord) but instead a diatonic note (note name B) as determined by the basic rule. Because, in a minor chord, the 5th interval is not so important as the minor third interval. In other words even when a chord constituting note is made to constitute an ensemble note by modifying the basic rule, it is not so effective to intensify the feeling of the chord of the minor chord, so that the exception 1 is not applied to this case.

EXCEPTION 2

Where a melody note is not a diatonic note but a note added with a sharp symbol and hence not a chord constituting note but where a scale note which is a semitone lower or higher than the melody note is a chord constituting note, the exception 1 is applied by deeming that a scale note which is a semitone lower or higher than that chord constituting note is a melody note. Because it is reasonable to apply the rule 1 by deeming a semitone note a semitone higher or lower than the chord constituting note as a whole scale note that is a chord constituting note because such chromatic scale note has such intimate relation with respect to a chord as a broderie, an appoggiatura, a passing note, a suspension or the like. For example, in the Ionian melody mode shown in FIG. *2a*, this exception 2 is applied for a melody note whose relative note (R N) is at the minor 6th (♭6°). Thus, where the note name G♯ which is the minor 6th semitone note (a chromatic scale note) at the C Ionian melody mode is a melody note, since a note name G a semitone lower than that melody note is a chord constituting note of the accompaniment note (C major note) at that time, a note name C (a syllable name do) which is a chord constituting note is selected as a 6th mode ensemble instead of a note name B (a syllable name si) a 6th lower than it.

EXCEPTION 3

Where a melody note is not a diatonic note, and hence not a chord constituting note at that time but is a chord constituting note a semitone higher or lower than that chord constituting note, a scale note a musical scale note a semitone higher or lower than the last mentioned chord constituting note is deemed as a melody note and the rule of exception 1 is applied thereto and at this time the same ensemble note is selected as the third mode and the 6th mode.

For example in the Ionian melody mode shown in FIG. *2a*, this exception 3 is applied to a melody note where the relative note (R N) is the minor second (♭2°). More particularly, where a note name C♯ is a melody note in a C Ionian melody mode, since a note name a semitone lower than the note name C♯ is a chord constituting note of an accompaniment chord (C major chord), a note name G which is one of its chord constituting notes is selected as the ensembles of the third and 6th modes.

EXCEPTION 4

Where a melody note is a chromatic scale note, it is deemed that a musical scale note a semitone higher or lower than the first mentioned chromatic scale note is a melody note and the basic rule described above is applied. For example, in the Ionian melody mode shown in FIG. *2a*, this exception 4 is applied to melody notes whose relative notes (R N) are minor third (♭3°) and minor 7th (♭7°) respectively. More particularly, with regard to a note name D♯ corresponding to the minor third (♭3°) it is deemed that a note name E a semitone higher than it is flattened (E♭) and a note name C a third lower than the note name E, and a note name G a third lower than the note name E are selected as the ensemble note of the third mode and the 6th mode for the note name D♯. Similarly, with regard to a note name A♯ corresponding to the minor 7th (♭7°), it is deemed that a note name B corresponding to the major 7th (7°) is flattened (B♭) and the same ensemble note as that for the major 7th (7°) is added thereto.

EXCEPTION 5

As the ensemble notes for the third and 6th modes, an ensemble note a third lower than a melody note is commonly used. However, where the melody note is a chromatic scale note, a musical scale note a semitone lower than the melody note is deemed as a melody note and an ensemble note, a third lower is used commonly for the third and the 6th modes. For example, an ensemble to be added to a relative melody note (note names A and F♯ in the G Mixolydia) of the major second (2°) and the major 7th (7°) in the Mixolydia shown in FIG. *2f* corresponds to that commonly used ensemble note.

FIG. 2 shows a summary of the ensemble notes of the third or 6th mode to be added to respective scale notes (relative note of a melody note) in respective melody modes selected by applying the basic rule and the exceptional rules described above. The interval relation between the melody note and the ensemble note shown in FIG. 2 does not vary even when the tonality is varied, but the positions of the prime notes of the musical scales of respective scale modes are shifted by a suitable value according to the prime note of the tonality (moved parallelly as a whole). The duet interval data generator 17 generates a duet interval data ΔD(3) and ΔD(6) that can realize the ensemble notes shown in FIG. 2 in accordance with a melody mode and the relative note (R N) of a melody note. FIG. 2 clearly shows that the third mode duet interval data ΔD(3) or the 6th mode duet interval data ΔD(6) to be outputted in accordance with the melody note relative notes (R N) in respective melody modes should have what interval content. For example, the third mode duet interval data ΔD(3) outputted corresponding to the first (1°) relative note (R.N) in the Phrygia melody mode (see FIG. 2*c*) should have a fourth interval, and according to the mode of expression shown in Table II, it should be "5" representing 5 semitones. In other words, the first (1!) relative note shown in FIG. 2*c* has a note name E (a syllable name mi), and the ensemble note for the 8th mode is a chord B (a syllable name si) a 4th lower. As a consequence, the data ΔD(3) should have 4 degrees interval. When a note name 4 degrees interval (5 semitones) lower shown by the data ΔD(3) is calculated with the arithmetic circuit 19, a note name B can be obtained showing that an ensemble note shown in FIG. 2*c* can be formed. In order to form ensemble notes shown in FIGS. 2*a* through 2*j* the duet interval data generator 17 is required to produce the interval data ΔD(3) or ΔD(6) in the third mode of the 6th mode according to the following Table III.

In Table III, data ΔD(3) and ΔD(6) are shown according to the mode of representation (number of the semitones) shown in Table II. While concrete data are shown in Table III regarding only the Ionian melody mode and the Doria melody mode and others are omitted, what data should be decribed can be understood from FIG. 2.

shown in FIG. 3 in which a high tone portion shows a melody performance performed by the keyboard 10 while a low tone portion an ensemble or duet note to be added. Suppose now that the designated tonality is the C tonality, that the accompaniment chord is the major chord and that the melody mode is the Ionian mode. Consequently when adding the ensemble note shown in FIG. 3, FIG. 2*a* is applied. At first the duet interval data generator 17 generates a third mode interval data D(3) so as to add the ensemble note in the third mode. More particularly, to the first melody note E4, (relative note is 3°) is added the C4 note a major third lower as the ensemble note, while to the second melody note is added the E4 note a minor third lower as the ensemble note. Since the third melody note is higher than its preceding note G4 by a major sixth, the ensemble note interval control device 18 detects that a condition for switching the note interval mode to the 6th mode has been established so as to designate the 6th mode for the duet interval data generator 17. Accordingly, in the case of the third melody note E5 (relative note is 3°) a duet interval data ΔD(6) of the 6th mode is outputted and the G note a major 6th lower is added as the ensemble note. Since the fourth melody note F5 is higher than the preceding note G4, again the duet interval data ΔD(6) of the 6th mode is produced and the A4 note a minor 6th lower than it is added as the ensemble note. The fifth melody note C5 is lower than its preceding note F5 by 4 degrees. Accordingly, the ensemble note interval control device 18 detects that a condition that returns the note interval mode to the third mode has been established (the fact that the note has lowered from the previous note more than a major second, that is whole notes) so as to designate the third mode to the duet interval data generator 17. As a consequence, the third mode interval data ΔD(3) is outputted corresponding to the fifth melody note C5 (relative note is 1°) and the G4 note a 4th lower than it is added as the ensemble note.

Since the melody mode is judged according to a chord, where no chord is detected, it is impossible to judge the melody mode and addition of the ensemble note by means of the duet interval data generator 17 would not be made. Any chord would not be detected by the chord detector 13 for the following two reasons.

TABLE III

| Melody Mode | | Relative Note (R N) | | | | | | | | | | | |
|---|---|---|---|---|---|---|---|---|---|---|---|---|---|
| | | 1° | b2° | 2° | b3° | 3° | 4° | b5° | 5° | b6° | 6° | b7° | 7° |
| Ionia | ΔD(3) | 5 | 6 | 3 | 3 | 4 | 3 | 4 | 3 | 4 | 4 | 3 | 3 |
| | ΔD(6) | 8 | 6 | 9 | 8 | 9 | 8 | 9 | 8 | 8 | 9 | 8 | 9 |
| Doria | ΔD(3) | 3 | 3 | 4 | 3 | 4 | 3 | 3 | 4 | 3 | 4 | 3 | 4 |
| | Δd(6) | 9 | 8 | 9 | 8 | 9 | 8 | 8 | 9 | 8 | 9 | 8 | 9 |
| Phrygia | ΔD(3) | | | | | | | | | | | | |
| | ΔD(6) | | | | | | | | | | | | |
| Minor | ΔD(3) | | | | | | | | | | | | |
| Mixolydia | ΔD(6) | | | | | | | | | | | | |
| Lydia | ΔD(3) | | | | | | | | | | | | |
| | ΔD(6) | | | | | | | | | | | | |
| Mixolydia | ΔD(3) | | | | | | | | | | | | |
| | ΔD(6) | | | | | | | | | | | | |
| Aeolia | ΔD(3) | | | | | | | | | | | | |
| | ΔD(6) | | | | | | | | | | | | |
| Locria | ΔD(3) | | | | | | | | | | | | |
| | ΔD(6) | | | | | | | | | | | | |
| Mode | ΔD(3) | | | | | | | | | | | | |
| Indefinite #1 | ΔD(6) | | | | | | | | | | | | |
| Mode | ΔD(3) | | | | | | | | | | | | |
| Indefinite #2 | ΔD(6) | | | | | | | | | | | | |

Some examples of the arithmetic operations relating to the ensemble note interval control device 18 are One is a case in which no chord is formed by the key depression at the keyboard 11, and the other is a case wherein although some chord would be formed by the key depression at the keyboard 11 for the reason that it is a special chord (for example, a diminished chord interval) it could not be detected by the chord detector 13. A not-formed chord in the former case might be neglected, but in the later case it is preferable to add a some sort of an ensemble note even when the chord detector 13 can not detect any chord. For this reason, a quasi-ensemble note forming circuit 20 is provided.

The quasi-ensemble note forming circuit 20 selects as an ensemble note (duet) a note closest to the melody note and on the side more than the minor third lower than the melody note among the melody constituting notes, provided that the chord detector 13 can not detect any chord. The reason for selecting the ensemble note under the condition of the presence of a chord constituting note lies in the following reason. Thus, since a chord composed of three notes can be satisfactorily detected by the chord detector 13 so that in a case where no chord is detected when the number of the chord constituting notes is 3 it is considered that no chord is formed actually, whereas when the number of the chord constituting notes is less than 2, it is considered as a mistouch during the chord key depression. Thus, it is considered that such special chord as a diminished chord interval that can not be detected with the chord detector 13 comprises more than 4 chord constituting notes. Furthermore, the reason for selecting a chord constituting note on the side lower than the melody note by a major third or more is to prevent a two degree interval that causes noise.

A second ensemble note (trio) forming circuit 21 is provided for the purpose of forming a second ensemble note, that is a trio note to be added further to the duet note described above. In this embodiment, a note closest to the duet note and on the side lower than it by a minor third or more is selected from the chord constituting notes and the selected note is as the second ensemble note. A musical tone composed of a duet note and a trio note is formed based on data DKC representing the duet note and data TKC by using musical note producing means, not shown in FIG. 1. When the number of the chord constituting notes is less than 3 so that no chord can not be detected by the chord detector 13 or where melody note keys are not depressed the circuit is constructed such that no duet note and trio note would be formed.

The detail of the construction of an embodiment of this invention will now be described with reference to FIG. 4 and the following figures.

Figure 4:
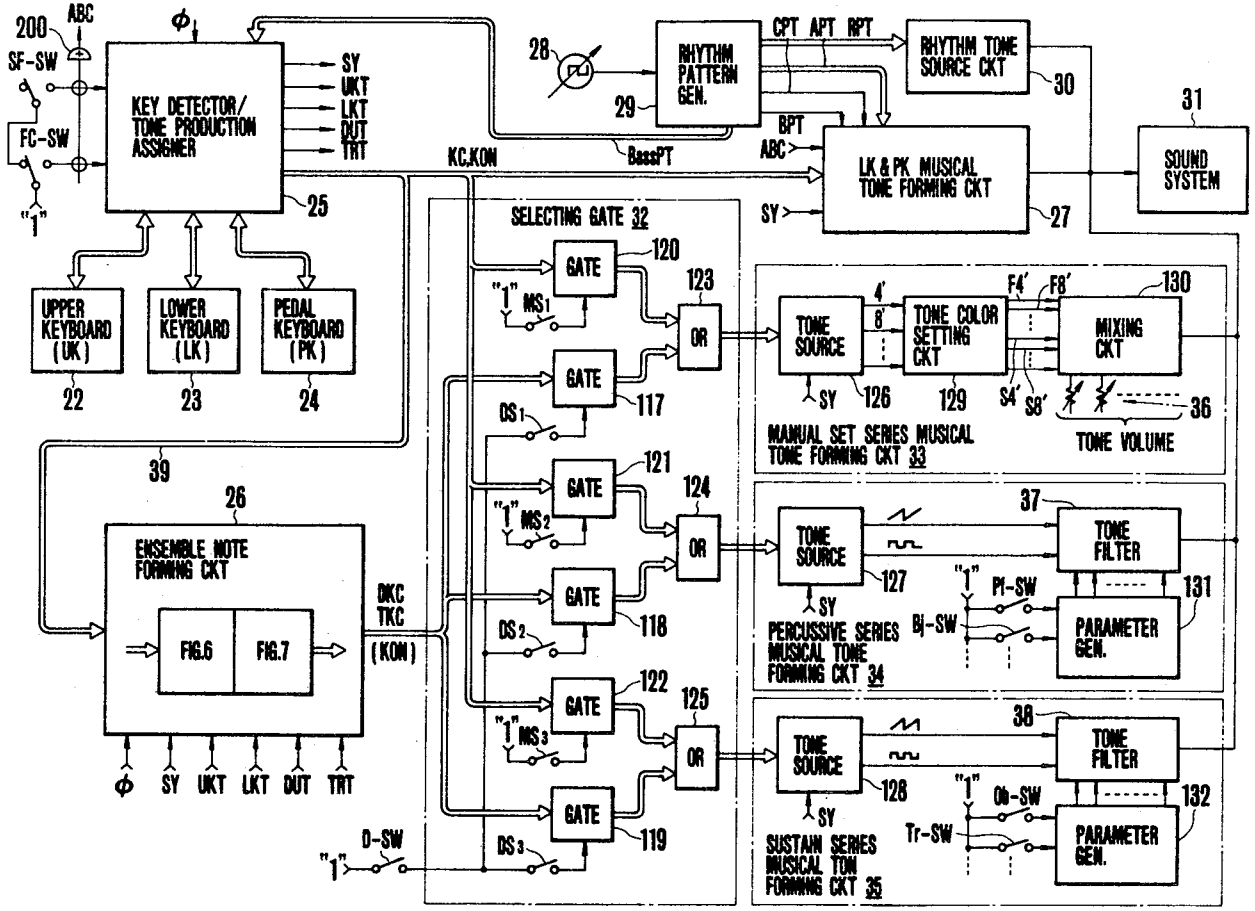
FIG. 4 is a block diagram showing the entire construction of one embodiment of the electronic musical instrument according to this invention.

In FIG. 4 an upper keyboard 22 is used for a melody performance and an ensemble note is added to the note (that is a melody note) produced by depressing the keys of the upper keyboard 22. A lower keyboard 23 and a pedal keyboard 24 are used for performing an accompainment, that is accompaniment chords and bass tones. For example, the upper and lower keyboard 22 and 23 respectively comprise 61 keys of from a key C2 to a key C7 while the pedal keyboard 24 is provided with 25 keys of from a key C2 to a key C4.

Figure 5:
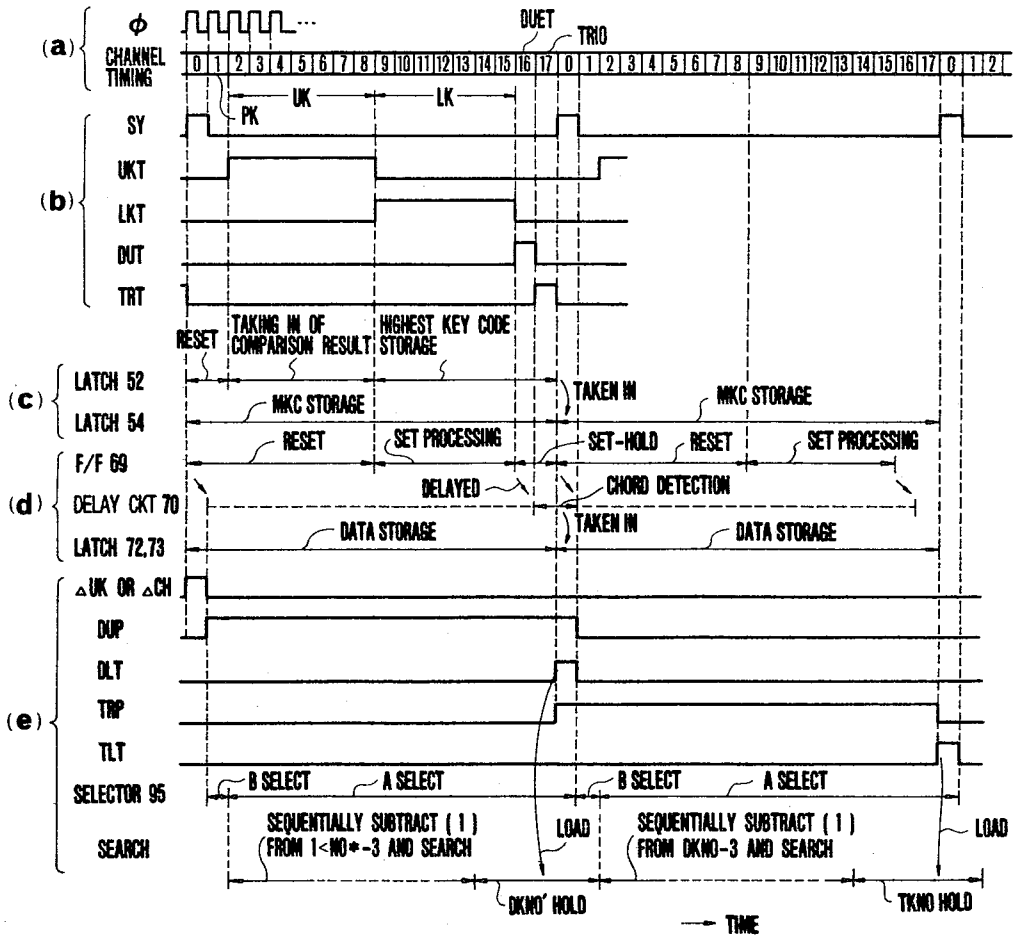
FIG. 5 is a timing chart useful to explain the operation of the embodiment shown in FIG. 4.

A depressed key detector and tone production assigner 25 detects depressed or released keys of respective keyboards 22, 23 and 24 so as to assign depressed keys to suitable musical tone producing channels. More particularly, the electronic musical instrument of this invention is provided with a limited number of the musical tone producing channels smaller than the total number of the keys and when a depressed key is assigned to any one of the musical tone producing channels a musical tone signal corresponding to the depressed key is produced in that channel. Musical tone producing channels commonly processed to form a musical tone (for example those imparted with the same tone color) are grouped. For example, these groups comprise, an upper keyboard channel group, a lower keyboard channel group, a pedal keyboard channel group, a duet note channel group and a trio note channel group. The depressed key detector and tone production assigner 25 performs, in a time division basis, the assignment processings regarding respective channels for producing, in a time division basis, key codes KC constituted by a plurality of bits and representing keys assigned to respective channels and one bit key-on signals KON representing whether the keys are being depressed or released for respective channels. One example of the time divisioned channel timing is shown in FIG. 5*a*.

As shown in FIG. 5*a*, the time width of one channel timing corresponds to one period (it is called one bit time) of a system clock pulse $\phi$ and its repetition interval is equal to 18 bit times. The total number of the musical tone producing channels is 17 and the first timing (the timing shown as 0 in FIG. 5*a*) in one cycle of repetition of the channel timing is a synchronizing timing not corresponding to any musical tone producing channel and respective channels are assigned to the remaining timings of 17 bit times. The pedal keyboard channel group (PK) comprises a single channel and its time divisioned timing is shown by the channel timing 1 shown in FIG. 5*a*. A depressed key of the pedal keyboard 24 is assigned to the pedal keyboard channel. The upper keyboard channel group (UK) comprises 7 channels and its time divisioned timings are shown by the channel timings 2 through 8 shown in FIG. 5*a*. To this upper keyboard channel group (UK) are assigned the depressed keys of the upper keyboard 22. Also the lower keyboard channel group (LK) comprises 7 channels and its time divisioned timings are shown by 9 through 15 shown in FIG. 5*a*. To the lower keyboard channel group (LK) are assigned depressed keys of the lower keyboard 23. The duet note musical tone producing channel comprises a single channel and its time divisioned timing is the timing 16 shown in FIG. 5*a*. Also the trio note musical tone producing channel comprises a single channel and its time divisioned timing is the timing 17 shown in FIG. 5*a*. The key codes KC and key-on signal KON produced from the tone production assignor 25 at the duet and trio channel timings 16 and 17 are all "0". The duet note and the trio note key codes KC and the key-on signals KON to be assigned at the channel timings 16 and 17 are formed in a duet note forming circuit 26.

Further, the tone production assigner 25 produces a synchronizing signal SY corresponding to the synchronizing timing 0, a upper keyboard timing signal UKT corresponding to the timings 2 through 8 of the upper keyboard channel group UK, a lower keyboard timing signal LKT corresponding to the timings 9 through 15 of the lower keyboard channel group LK, a duet channel timing signal DUT corresponding to the channel timing 16 of the duet note, and a trio channel timing signal corresponding to the channel timing 17 of the trio note, with a mutual relation as shown in FIG. 5*b*.

Switches SF-SW and FC-SW combined with the depressed key detector and tone production assigner 25 are provided for performing an automatic bass chord performance. Where a finger code mode selection switch FC-SW is closed, an automatic bass chord performance is performed in a fingered chord mode, whereas when the single finger mode selection switch SF-SW is closed, an automatic bass chord performance is performed in a single finger mode. Switches FC-SW and SF-SW are connected so as to give priority to switch FC-SW. In the case of the single fingered chord mode, a depressed key of the lower keyboard 23 is assigned as it is to the lower keyboard channel group LK. In the case of the single fingered mode, a depressed key of the lower keyboard 23 is made to correspond to the root note for determining the types of the 7th, minor and major chords depending upon whether a natural (white) or sharp (black) key of the pedal keyboard 24 is depressed or not. The key codes KC of a plurality of chord constituting notes are automatically formed based on the root note and the type of the chord and such automatically formed key codes KC are assigned to either one of the lower keyboard channel groups LK. In the case of the fingered chord mode and the single finger mode, in accordance with a bass patter BassPT produced by a rythm pattern generator 29 to be described hereinafter and a chord performed on the lower keyboard 23, a key code having a bass note corresponding to the bass pattern is formed automatically and the bass note key code thus formed is assigned to the pedal keyboard channel PK (at channel timing 1). As above described, the depressed key detector and tone production assigner 25 also has a capability of forming a key code for the automatic bass chord performance. Accordingly, the key codes assigned to the lower keyboard channel group LK are not limited to actually depressed keys on the lower keyboard 23 but also include those automatically formed in relation to the depressed key notes of the lower keyboard 23.

In a lower keyboard (LK) and pedal keyboard (PK) musical tone forming circuit 27 the notes (the depressed key notes of the lower keyboard or an accompaniment chord) assigned to respective channels of the lower keyboard channel group LK are respectively formed by a method of forming a musical tone exclusively used for the lower keyboard, while the notes assigned to the pedal keyboard channel PK (depressed key notes of the pedal keyboard, that is a bass note) are respectively formed by the method of forming a musical tone exclusively used for the pedal keyboard. Consequently, in response to the key code KC, the key-on signal KON and the synchronizing signal SY outputted from the tone production assigner 25 on the time division basis, the circuit 27 selects the key code KC and the key-on signal KON assigned to respective channels of the lower keyboard channel group LK so as to form a musical tone based on these selected signals according to the method of forming a musical tone exclusively used for the lower keyboard. The circuit 27 also selects the key code KC and the key-on signal KON assigned to the pedal keyboard channel PK so as to form a musical note according to a method of forming a musical tone exclusively used for the pedal keyboard. In the case of an automatic performance, a tempo oscillator 28 is operated to cause a rythm pattern generator 29 to produce a rythm pattern generator 29 to produce a rythm pattern RPT, a bass pattern BassPT, a pattern BPT showing a production timing of a bass note corresponding to the bass pattern BassPT, a chord production timing pattern CPT, an arpeggio pattern APT, etc. which are applied to the musical tone circuit 27 and a rhythm tone source circuit 30. The outputs of the fingered code mode selection switch FC-SW and the single finger mode selection switch SF-SW are applied to the inputs of an OR gate circuit 200 for producing therefrom an automatic bass chord selection signal ABC, which is applied to the LK/PK musical tone forming circuit 27. This circuit 27 controls the production of a musical tone (bass tone) formed by the pedal keyboard channel PK when the signal AB is "1" (that is when the automatic bass chord performance in the fingered mode or the single finger mode is selected), at the timing of the bass note production timing pattern BPT. Further, the circuit 27 simultaneously controls the tone production of respective musical tones (chord) formed in the lower keyboard channel group LK in accordance with the chord production timing pattern CPT and also controls the tone production of their chord constituting notes so as to produce them, one after another, (in an arpeggio form) according to the arpeggio pattern APT. The rhythm source circuit 30 produces a rythm note in response to the rhythm pattern RPT. The outputs of the lower keyboard and pedal keyboard musical tone forming circuit 27 and the rythm tone source circuit 30 are applied to a sound system 31.

In this embodiment, there are 3 series of the musical tone forming circuits for the melody note (depressed key notes) of the upper keyboard and ensemble notes (duet and trio) and these 3 series are combined into any desired combination by the switching of a selecting gate circuit 32. Respective musical tone forming circuits 33, 34 and 35 form musical tones with specific methods (for example, a method of forming a tone color or an envelope). For example, in the method of forming a tone color, in the tone volume type musical tone forming circuit 33, a plurality of tone volumes (variable resistors) 36 are used to adjust the tone color as desired by the performer, whereas in the percussive musical tone forming circuit 34 and the sustained type musical tone forming circuit 35, tone filters 37 and 38 are used to form preset tone colors. To apply an envelope, in the tone volume type musical tone forming circuit 33 and the sustain type musical tone forming circuit 33, a sustain type amplitude envelope (an envelope that sustains tone production while the key is being depressed) is imparted to the musical tone, whereas in the percussion type musical tone forming circuit, a percussive type amplitude envelope is imparted to the musical tone. The detail of the musical tone forming circuits 33, 34, 35 and the selecting gate circuit 32 will be described later.

Based on the upper keyboard channel group UK and on the lower keyboard channel group LK among those relating to the key codes KC and key-on signals KON of respective channels supplied from the tone production assigner 25 over a line 39, the duet note forming circuit 26 forms duet note as has already been described with reference to FIG. 1 to form a duet note key code DKC and a trio note key code TKC. The duet note forming circuit 26 is shown in FIGS. 6 and 7 each showing one portion.

Figure 6:
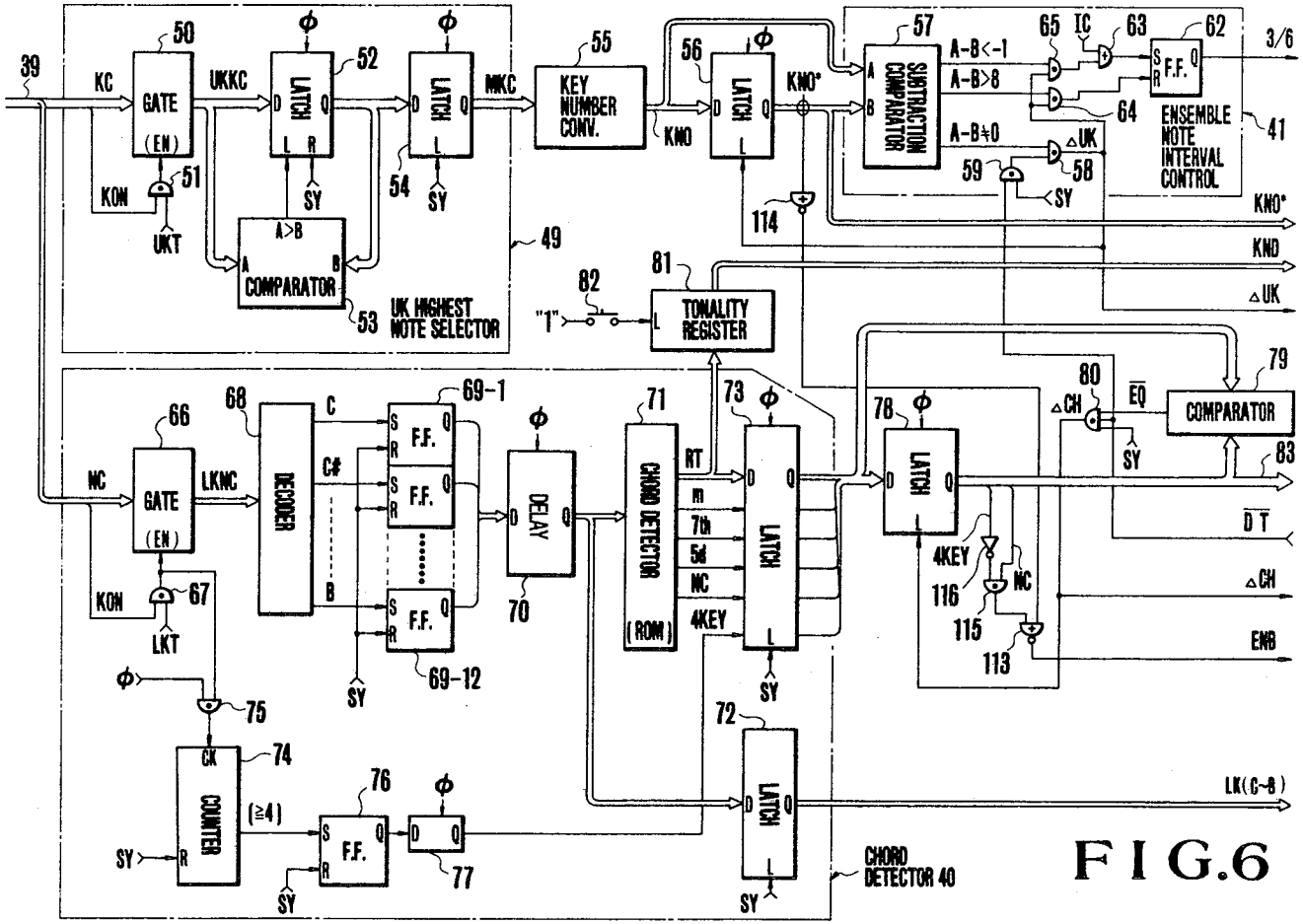
FIGS. 6 and 7 are block diagrams which when combined shows the detail of the ensemble note forming circuit of the embodiment shown in FIG. 4.
Figure 7:
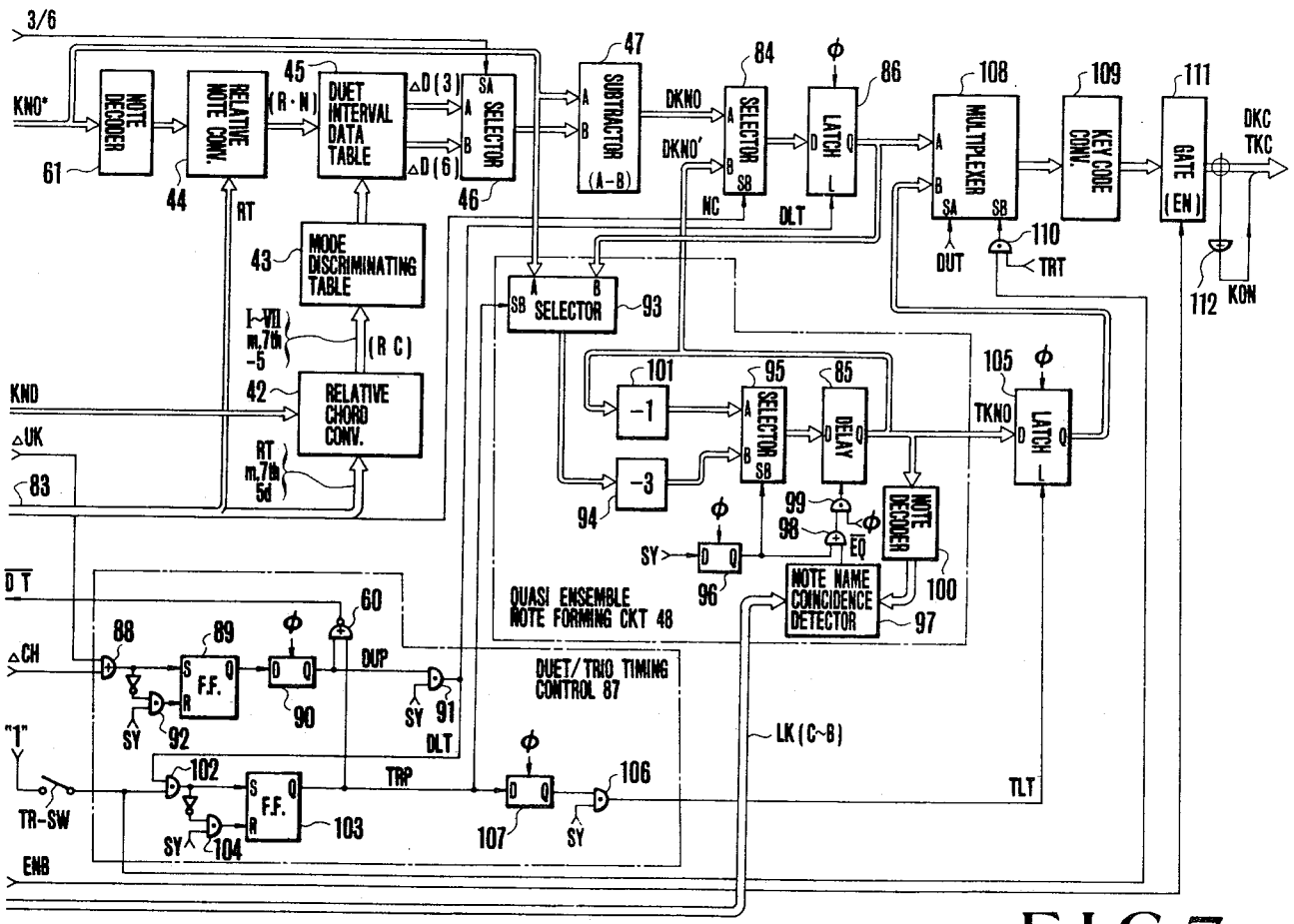

The portion shown in FIG. 6 contains circuits 40 and 41 corresponding to the chord detector 13, and the ensemble note interval control device 18 shown in FIG. 1 while the other portion shown in FIG. 7 contains circuits 42 through 48 corresponding to the absolute/relative chord converter 14, the melody mode discriminator 15, the absolute/relative note converter 16, the duet interval data generator 17, the arithmetic circuit 19, the quasi-ensemble note forming circuit 20 and the second ensemble note forming circuit 21.

In FIG. 6, time divisioned key codes KC and key-on signals KON of respective channels which are supplied from the tone production assigner 25 over a line 39 are applied to the UK highest note selector 49 and a chord detector 40. The UK highest note selector 49 selects the highest note among the depressed key notes of the upper keyboard. This is done for the reason that where a plurality of keys of the upper keyboard are simultaneously depressed an ensemble note is to be added by taking the highest note as a reference (as a melody note to be added with the ensemble note). It is to be understood that the melody note to be added with the ensemble note is not always limited to the highest note, and that it may be a lowest note or an intermediate note so long as the selector 49 selects a predetermined single note.

The key code KC on line 39 is inputted to a gate circuit 50, while the key-on signal KON to one input of an AND gate circuit 51. The other input of the AND gate circuit 51 is supplied with the upper keyboard timing signal UKT (see FIG. 5) and the output of this AND gate circuit 51 is applied to an enabling input EN of the gate circuit 50. As a consequence, the gate circuit 50 selects key codes KC corresponding to depressed keys (key-on signals KON are "1") among the key codes assigned to the upper keyboard channel group UK. The output of the gate circuit 50 (that is the upper keyboard depressed key key codes UKKC) is supplied to the D input of a latch circuit 52 and the A input of a comparator 53. The B input of the comparator 53 is supplied with the output of the latch circuit 52, and where A>B, the comparator 53 sends a signal "1" to the load control input L of the latch circuit 52 which is reset by the synchronizing signal SY (see FIG. 5) at the beginning of each cycle of the channel timing. The higher is the pitch the larger is the value of the keycode KC. Accordingly, where the UK depressed key key code UKKC outputted from the gate circuit 50 is larger than the key code latched in the latch circuit 52, the condition A>B holds in the comparator 53 and that key code UKKC is received in the latch circuit 52. Since this latch circuit 52 is reset at the beginning of one cycle of the channel timing, the key code UKKC firstly outputted from the gate circuit 50 in that cycle would be latched in the latch circuit 52. Thereafter, the key codes UKKC assigned to the respective channels of the upper keyboard channel group UK are sequentially compared each other to latch key codes UKKC on the higher tone side in the latch circuit 52, and when the last channel timing 8 of this group UK elapses, the UK highest depressed key would be latched in the latch circuit 52. The latch circuit 52 and the latch circuits shown in FIGS. 6 and 7 are supplied with the system clock pulse $\phi$ so as to synchronize the input and output timings by the system clock pulse $\phi$. Consequently, a newly received data is outputed one bit later.

The output of the latch circuit 52 is sent to another latch circuit 54 which takes in the output of the latch circuit 52 at the time of generating the synchronizing signal SY. Although the latch circuit 52 is reset by the timing action of the synchronizing signal SY, since the output bit timing is lagged one bit as above described, the latch content immediately before reset, that is the key code MKC of the UK highest note depressed key is received in the latch circuit 54. The key code MKC of the highest note depressed key would be held or stored until a synchronizing signal SY of the next cycle is generated. In this manner, the latch circuit 54 continuously stores the key code of the UK highest note depressed key. The states of the latch circuits 52 and 54 are diagrammatically shown in FIG. 5c.

The key code MKC of the highest note depressed key selected by the UK highest note selector 49 in a manner described above (that is the key code of a melody note) is sent to a key note number converter 55 to convert an arrangement in the order of the pitches of respective keys into a key note comprising a continuous arrangement of data. In this embodiment, as shown in the following Table IV, since the key codes KC comprise a discontinuous arrangement of data (keys are arranged according to their pitches), the computation of the interval is troublesome. For this reason, to make easy the computation of the interval, the discontinuous arrangement of data is converted into a key note number KNO comprising a continuous arrangement of data.

TABLE IV

| | Key Code KC | | | | | | | |
|---|---|---|---|---|---|---|---|---|
| key range | octave code | | | note name | note code NC | | | |
| C2–B2 | 0 | 0 | 1 | C | 0 | 0 | 0 | 1 |
| C3–B3 | 0 | 1 | 0 | C# | 0 | 0 | 1 | 0 |
| C4–B4 | 0 | 1 | 1 | D | 0 | 0 | 1 | 1 |
| C5–B5 | 1 | 0 | 0 | D# | 0 | 1 | 0 | 1 |
| C6–B6 | 1 | 0 | 1 | E | 0 | 1 | 1 | 0 |
| C7 | 1 | 1 | 0 | F | 0 | 1 | 1 | 1 |
| | | | | F# | 1 | 0 | 0 | 1 |
| | | | | G | 1 | 0 | 1 | 0 |
| | | | | G# | 1 | 0 | 1 | 1 |
| | | | | A | 1 | 1 | 0 | 1 |
| | | | | A# | 1 | 1 | 1 | 0 |
| | | | | B | 1 | 1 | 1 | 1 |

Each key code KC (also MKC) comprises a total of 7 bits, namely a 3 bit octave code OC and a 4 bit note code NC, and as shown in Table IV, the octave codes OC show key ranges of respective octaves while the note codes NC represents the note name in one octave. As the column of the note code NC shows the difference between note codes, that is adjacent note names D and D#, F and F#, G# and A, and B and C are each decimal 2, meaning a discontinuously. On the other hand, in the key note number KNO produced by the key note number converter 55 6 bit binary values of from "000001" to "111101" are continuously assigned to the 61 keys of from the lowest note key C2 to the highest note key C7 as shown in the following Table V. Accordingly, the differences in the values of the key note numbers KNO corresponding to the respective keys C2 through C7 become values that directly represent the intervals between respective key notes in terms of the number of the semitones, thus permitting computation of the interval with simple addition and subtraction operations. The key note number converter 55 outputs a note number KNO of a value corresponding to the key note name of the key code of an inputted melody note.

TABLE V

| | key note number KNO | | | | | | |
|---|---|---|---|---|---|---|---|
| | KNO | | | | | | |
| key note name | binary representation | | | | | | decimal representation |
| C2 | 0 | 0 | 0 | 0 | 0 | 1 | 1 |
| C#2 | 0 | 0 | 0 | 0 | 1 | 0 | 2 |
| D2 | 0 | 0 | 0 | 0 | 1 | 1 | 3 |
| . | | | . | | | | . |
| . | | | . | | | | . |
| . | | | . | | | | . |

TABLE V-continued

| key note name | key note number KNO KNO binary representation | | | | | | decimal representation |
|---|---|---|---|---|---|---|---|
| B6 | 1 | 1 | 1 | 1 | 0 | 0 | 60 |
| C7 | 1 | 1 | 1 | 1 | 0 | 1 | 61 |

A key note number KNO representing the melody note outputted from the key note number converter 55 is applied to the D input of a latch circuit 56 and the A input of a subtraction comparator 57. The B input of the subtraction comparator 57 is supplied with the output of the latch circuit 56. To the load control input L of the latch circuit 56 is applied a melody change detection signal ΔUK outputted from an AND gate circuit 58. When the key note number converter 55 produces the key note number KNO of a new melody note, the latch circuit 56 is storing the key note number KNO* of an old melody note. The subtraction comparator 57 calculates the difference (A-B) between the key note number KNO (A input) of a new melody note and the key note number KNO* (B input) of the old melody note so as to check whether this difference satisfies a relation [A−B<−1] or [A−B>8] or [A−B≠0] or not.

Where the new key note number KNO and the old key note number KNO* are the same, that is when the key note number KNO outputted from the converter 55 is equal to the key note number KNO* which has already been stored in the latch circuit 56, the outputs of the subtraction comparator 57 are all "0" thus causing no change.

Where the new key note number KNO and the old key note number KNO* are not equal, the condition [A−B≠0] holds in the subtraction comparator 57, thereby applying a signal "1" to one input of the AND gate circuit 58 with its other input connected to receive the output of AND gate circuit 59 which is inputted with a synchronizing signal SY and a signal $\overline{D}\,\overline{T}$ outputted from an NOR gate circuit 60 shown in FIG. 7. Suppose now that this signal $\overline{D}\,\overline{T}$ is "1", then the output of the AND gate circuit 59 becomes "1" when the synchronizing signal SY is generated and in response to this output the melody change detection signal ΔUK outputted by the AND gate circuit 58 also becomes "1". Then the latch circuit 56 takes in a new key note number KNO. One bit time later the output KNO* of the latch circuit 56 changes to a new key note number, whereby a condition [A−B≠0] does not hold in the subtraction comparator 57. In this manner, when the upper keyboard highest note depressed key, that is a chord to which an ensemble note is to be added changes, a key note number KNO representing a new melody note appearing after the change would be stored in the latch circuit 56. The condition [A−B≠0] of the subtraction comparator 57 holds not only when the note changes to another note but also immediately after keys regarding the melody note are all released so that the output KNO of the converter 55 is latched by the latch circuit 56. All bits of the output KNO at that time are "0" because there is no depressed key and the all bits of the content stored in the latch circuit 56 are "0".

The output KNO* of the latch circuit 56 is supplied to a subtractor 47 and a note decoder 61 shown in FIG. 7 to act a key note number representing the present melody note.

The outputs of the subtraction comparator 57 under conditions [A−B<−1] and [A−B>8] are used for controlling the switching between the third mode and 6th mode. The state of a flip-flop circuit 62 shows the third or 6th mode. An initial clear signal IC generated at the time of closing a power source switch is applied to the set input S of the flip-flop circuit 62 via an OR gate circuit 63 to preset the flip-flop circuit. The output of this flip-flop circuit is applied to a selector 46 shown in FIG. 7 as a degree mode switching signal 3/6. When the degree mode switching signal 3/6 is "1" it shows a third mode, while when it is "0" it shows 6th mode. Consequently, in the initial state, by setting the flip-flop circuit 62 with the initial clear signal IC, the degree mode switching signal 3/6 becomes "1" showing the third mode.

Where the difference (A−B) between the key note number KNO of a new melody note outputted from the key note number converter 55 and the key note number KNO* of the melody note latched in the latch circuit 56 is larger than 8, a condition [A−B>8] holds in the subtraction comparator 57 and a signal "1" is applied to one input of AND gate circuit 64 while its other input is supplied with a melody change detection signal ΔUK from the AND gate circuit 58. As a consequence, the AND gate circuit 64 produces an output "1" by the timing action of the synchronizing signal SY to reset the flip-flop circuit 62. Holding of the codition [A−B>8] means that the present melody-note is higher than the previous melody note by more than a major 6th or more. Thus the flip-flop circuit 62 is reset and the degree mode switching signal 3/6 is switched to "0" thus representing the 6th mode.

Thereafter, when the difference (A−B) between the key note number KNO and the previous key note number KNO* becomes smaller than −1, a condition [A−B<−1] holds in the subtraction comparator 57, thus applying a signal "1" to one input of the AND gate circuit 65. Since the other input of this AND gate circuit is supplied with signal UK from the AND gate circuit 58, the output of the AND gate circuit 65 becomes "1" at the time of generating a synchronizing signal SY, thus resetting the flip-flop circuit 62 via OR gate circuit 63. Holding of a condition [A−B<−1] means that the present melody note is lower than the previous melody note by more than a semitone (minor second) that is by a whole note (major second) or more. As a consequence, the flip-flop circuit 62 is reset to switch the degree mode switching signal 3/6 to "1", thereby returning to the third mode.

As above described the switching between the third mode and the 6th mode is effected by the ensemble note interval control circuit 41 including the subtraction comparator 57 and the flip-flop circuit 62.

The detail of a chord detector 40 will now be described with reference to FIG. 6.

Among the key codes KC on line 39 only the note code NC is applied to a gate circuit 66, while a key-on signal KON is applied to one input of an AND gate circuit 67 with its other input connected to receive the lower keyboard timing signal LKT (see FIG. 5*b*). The output of the AND gate circuit 67 is applied to the enabling input EN of the gate circuit 66. Thus, the gate circuit 66 selects only the note code LKNC of a depressed key assigned to the lower keyboard channel group LK. The note code LKNC selected by the gate circuit 66 is supplied to a decoder 68 to be decoded corresponding to respective note names C through B.

The outputs of the decoder 68 corresponding to respective note names C through B are applied to set inputs respectively of 12 flip-flop circuits 69-1 through 69-12. A synchronizing signal SY is applied to the reset inputs R of the flip-flop circuits 69-1 through 69-12 so that these flip-flop circuits are all reset at the beginning of each cycle of the channel timing. Thereafter, at the time when the note code LKNC of the LK depressed key is selected in that cycle, only a flip-flop circuit corresponding to the note name of the note code LKNC would be reset. Consequently, in each cycle, when the last channel timing 5 (see FIG. 5*a*) of the lower keyboard channel group LK has elapsed, the flip-flop circuits (one or more of the flip-flop circuits 69-1 through 69-12) corresponding to the note names of the LK depressed keys are set. The outputs of the flip-flop circuits 69-1 through 69-12 are delayed one bit time by a delay circuit 70 and then applied to a chord detector 71 and a latch circuit 72. The chord detector ROM 71 detects whether there is a chord or not based on a combination of the note names of the LK depressed keys applied thereto via a delay circuit 70 and constituted by a read only memory device (ROM) for example. Where a chord is detected, the chord detector 71 produces data RT representing its root note, data m representing the type of the chord, and data 7th. For example, the root note data RT comprises a 12 bit signal corresponding to the note names C through B and only one signal corresponding to the root name at this time becomes "1". Where a minor third note with reference to the root note presents, the minor chord data m becomes "1", whereas when a minor 7th note presents, the 7th chord data 7th becomes "1". The 5th data 5*d* becomes "1" when a perfect 5th note presents in the chord constituting notes. This 5th data 5*d* is used to detect a 7th alternate minor seventh chord VIIm7-5 (see Table I) utilized to judge the Locria melody mode. More particularly, in this embodiment, where the 5th data 5*d* is "0" when the minor seventh chord VIIm7 is detected without confirming the presence of the diminished 5th note which is a condition of the 7th alternate minor seventh chord VIIm7-5, it is deemed as the alternate minor seventh chord VIIm7-5. Such processing is executed in a relative chord converter 42 shown in FIG. 7. With this measure it becomes unnecessary to incorporate into the chord detector 71 a logic circuit for detecting the diminished fifth note, thus simplifying the circuit construction. Where the chord detector 71 can not detect a chord, a chord-not-formed signal NC becomes "1".

The respective outputs RT, m, 7th, 5*d* and NC are applied to a latch circuit 73. A synchronizing signal SY is applied to the load control input L of the latch circuits 73 and 72. The operations of the circuit extending between the flip-flop circuits 69-1 through 69-12 and latch circuits 72 and 73 are diagrammatically shown in FIG. 5*d*. The setting of the flip-flop circuits 69-1 through 69-12 corresponding to the note names of the lower keyboard depressed keys has already been completed at the channel timing 15 as has been described hereinaboe, and their set states are maintained during the 2 bit times of the channel timings 16 and 17 and all reset by the synchronizing signal S at the next timing 0. However, due to the presence of the delay circuit 70, as the outputs of the flip-flop circuits 69-1 through 69-12 are delayed one bit time, a signal showing a set state is produced by the delay circuit 70 during 2 bit times between the channel timings 17 and 0 and applied to the chord detector 71 and the latch circuit 72. Consequently, during the 2 bit times, the detector 71 detects a chord so that correct chord data RT, m, 7th, 5*d* and NC are supplied to the latch circuit 73 from the ROM 71 at the channel timing 0 at which the synchronizing signal SY is generated. At the same time, data representing correct chord constituting notes (or the lower keyboard depressed keys) are also supplied to the latch circuit 72 from the delay circuit 70. The data taken into the latch circuits 72 and 73 are continuously held until a new data is taken in at the timing 0 of the next cycle.

A counter 74 is provided for the purpose of counting the number of the chord constituting notes. A synchronizing signal SY is applied to the reset terminal R of the counter 74 so as to reset the same at each cycle of a channel timing. To the count input CK of the counter 74 is applied a system clock pulse $\phi$ via and AND gate circuit 75 which is enabled when the output of the AND gate circuit 67 is "1". As a result, the system clock pulse $\phi$ is selected at a timing at which a key-on signal KON is "1" among the lower keyboard channel timings 9 through 15 (see FIG. 5*a*) and applied to the counter 74. Thus, the counter 74 counts the number of the LK depressed keys at each cycle. When the count of this counter 74 is larger than or equal to 4, the output signal ($\geqq 4$) showing the count is 4 or larger becomes "1" which is applied to the reset input S of a flip-flop circuit 76 which is reset by the synchronizing signal SY at each cycle. When the last channel timing 15 of the lower keyboard channel group LK has elapsed, the flip-flop circuit 76 would be set when the number of the LK depressed keys is equal to or larger than 4. The Q output of this flip-flop circuit 76 is delayed one bit time by a delay flip-flop circuit 77 and then applied to the latch circuit 73 as a 4-key-or-more signal 4KEY. As above described, the latch circuit 73 takes in the date by the timing action of the synchronizing signal SY. On the otherhand, the flip-flop circuit 76 is reset by the timing action of the synchronizing signal SY. For the same reason for providing the delay circuit 70, for the purpose of positively storing the state of the flip flop circuit 76 immediately prior to the resetting (that is a 4-key -or-more signal), a delay flip-flop circuit 77 is provided. The 4-key-or-more signal is utilized for detecting whether there are 4-or-more chord constituting notes when a certain chord is not established.

A latch circuit 78 and a comparator 79 are provided for the purpose of detecting the change in the accompaniment chord. When the latch circuit 73 produces new chord data RT, m, 7th, 5*d*, NC and 4KEY, the latch circuit 78 is outputting data representing old states of these chord data. The comparator 79 compares with each other the outputs of the latch circuits 73 and 74, and when two outputs do not coincide with each other, that is the chord has changed, a noncoincidence output $\overline{EQ}$ is changed to "1". An AND gate circuit 80 is supplied with the noncoincidence output $\overline{EQ}$, a synchronizing signal SY, a signal $\overline{D}\,\overline{T}$ supplied from the NOR gate circuit 60 shown in FIG. 7. where the signal $\overline{D}\,\overline{T}$ is "1", as the noncoincidence output $\overline{EQ}$ becomes "1", the AND gate circuit 80 produces an output "1" when the synchronizing signal SY is generated. The output "1" of the AND gate circuit 80 is applied to the load control input L of the latch circuit 78 to act as a chord change detection signal $\Delta$CH. Consequently, when the chord changes, more strictly when the states of data RT, m, 7th, 5*d*, 4KEY regarding a chord change, their new data RT, m, 7th, 5*d*, NC and 4KEY latched in the latch circuit 73 are stored in the latch circuit 78.

A tonality register 81 is provided for the purpose of storing note name data representing the prime note of a designated tonality. In this embodiment, before the performance, a tonality designation is made by forming a chord having the prime note of a desired tonality by depressing the keys of the lower keyboard 23 (FIG. 4) concurrently with the depression of a tonality designating switch 82. Then, the root note data outputted from the chord detection 71 shows the note name of the prime note of the tonality and the root note data is applied to the tonality register 81, the load control input L thereof being applied with a signal "1". When the tonality designation switch is closed. As a consequence, when the tonality designation switch 82 is closed, a note data (root note data RT) representing the prime note of the desired tonality would be stored in the tonality register 81. The primary note data KND stored in the tonality register 81 is supplied to the relative note converter 42 shown in FIG. 7.

The data RT, m, 7th, 5*d*, NC and 4KEY relating to a chord stored in the latch circuit 78 are also supplied to the circuits shown in FIG. 7 through a line 83. Of these data, the root note data RT is applied to the relative chord converter 42 and the relative note converter 44, whereas the data that is minor chord data m, the seventh chord data 7th and the 5th data 5*d* are also applied to the relative chord converter 42.

The relative chord converter 42 has the same function as the relative chord converter 14 shown in FIG. 1, that is it converts an absolute chord into a relative chord R C for the prime note of a tonality. More particularly, it converts the note name of a root note represented by a root note data into degrees (the prime note is 1°) of the note name of a tonality prime note represented by a tonality prime note data KND and produces the root note data I (1°), I♯ (minor second), II (major second) . . . VII (major 7th) corresponding to the degrees. The minor chord data m and the seventh chord data 7th are outputted as they are. The fifth data 5*d* is utilized only when the relative chord R C is the minor 7th chord VII7 and neglected in other cases. More particularly, when the root note degree data is VII representing the major 7th, and both minor chord data m and the 7th chord data are "1" (that is when a perfect fifth note interval present), a signal "0" is outputted as diminished fifth data [−5] where the fifth data 5*d* is "1", whereas when the fifth data 5*d* is "0" a signal "1" is outputted as the diminished fifth data [−5]. Where the diminished fifth data [−5] is "1" it shows 7th alternate minor seventh chord VIIm7-5, whereas when it is "0", it melody shows minor seventh chord note VIIm7. Because, in connection with the fifth chord, it is necessary to detect the alternate minor seventh chord note VIIm7-5 necessary to judge the Locria melody note prior to a minor seventh chord VIIm whose mode is not known.

The relative chord converter 42 produces data I through IIm, m, 7th, and −5 based on a combination representing either one of the relative chords R C shown in Table I. These outputs are inputted to melody mode judging Table 43.

The melody mode judging Table 43 outputs data representing one melody note corresponding to an inputted relative chord (R C) according to the melody mode judging table as shown in Table I. The data representing the melody mode is stored in a duet interval data Table 45 which prestores a duet interval data table prepared according to FIG. 2 and shown in Table III to read out a third mode duet interval data ΔD(3) and a 6th mode duet interval data ΔD(6) in accordance with the relative note R N of a melody note outputted from a relative note converter 44 and with a melody note judged by the scale mode judging table 43.

A note decoder 61 is provided for decoding the key note number KNO* of a melody note produced by the latch circuit as for only its note names (12 note names C through B). Only the line corresponding to the note name of a melody note (UK highest note depressed key) among 12 output lines corresponding to the respective note names C through B of the note decoder 61 becomes "1" which is applied to the relative note converter 44. This converter 44 has the same function as the relative note converter 16 shown in FIG. 1 and outputs data representing the degree of a melody note (output of the note decoder 61), that is data representing the relative note (R N) by representing the root note name of a chord shown by the root note data as one degree. The third and 6th duet interval data ΔD(3) and ΔD(6) read out of the table 45 according to the melody mode and the relative note (R N) by representing the root note name of a chord shown by the root note data as one degree. The third and 6th duet interval data ΔD(3) and ΔD(6) read out of the table 45 according to the melody mode and the relative note (R N) are applied to A input and B input respectively of the selector 46.

For example, when the tonality prime data KND shows a note name D, the root note data RT is a note name E, the minor chord data m is "1" and the 7th chord data 7th is "0", in other words where a E minor chord is performed with a D tonality, among the root note degree data I through VII outputted from the relative chord converter 42 only the II showing the major second is "1" because the root note E has a major second interval with respect to the prime note name D. Consequently, the relative chord R C inputted to the melody mode judging table 43 becomes a major second minor chord IIm, as shown in Table I, and the table 43 outputs data representing a Doria melody mode. When the melody note is an F4 note at this time, the note decoder 61 outputs data representing the note name F, whereas the relative note converter 44 outputs a relative note (R N) representing a minor second (♭2°), that is an interval of the note name F of the melody note for the root name E. Consequently, the melody mode inputted to the duet interval data table 45 represents a Doria melody note whereas the relative note R N shows a minor second (♭2°) and as can be noted from a note representing the position of the minor second (♭2°) at a musical scale of the Doria melody mode shown in FIG. 2*b*, or can be noted from Table III, a value 3 showing the minor third is read out as the third mode duet interval data ΔD(3) and a value 8 showing a minor 6th is read out as a 6th duet interval data ΔD(6).

To the A select control input SA of the selector 46 is applied a interval mode switching signal 3/6 outputted from the flip-flop circuit 62 shown in FIG. 6. When this signal 3/6 is "1", the selector 46 selects the third mode interval data ΔD(3) applied to the A input to select the 6th mode interval data ΔD(6) applied to the B input when it is "0". The interval data ΔD(3) or ΔD(6) selected by the selector 46 is applied to the B input of a subtractor 47. Since the key note number KNO* of the melody note is applied to the A input of the subtractor 47 it calculates a subtraction A−B. As a consequence a key note number DKNO representing the difference between the key note number KNO* and the interval data ΔD(3) or ΔD(6), that is the tone pitch of an ensemble note (duet) can be obtained. The key note number DKNO of this ensemble note shows a note lower than a melody note shown by a key note number KNO* by a semitone shown by the interval data ΔD(3) or ΔD(6).

The key note number DKNO of an ensemble note outputted from the subtractor 47 is applied to the A input of a selector 84, and the B select control input SB thereof is applied with a chord not formed signal NC sent from the latch circuit 78 shown in FIG. 6 over a line 83. When a chord is formed, this signal NC is "0" so that the selector 84 selects the key note number DKNO applied to its A input. In other words, the selector 84 selects a key note number DKNO of an ensemble note suitable for the melody mode judged in accordance with a chord. When a chord is not formed, the chord not-formed signal NC is "1" and the selector 84 selects the B input. The output DKNO of the subtractor 47 under such condition is of no use it is blocked by the selector 84. To the B input of the selector 84 is applied the key note number DKNO' of an ensemble note for a case wherein no chord is formed by the delay circuit 85 of then quasi ensemble note forming circuit 48.

The key note number DKNO or DKNO' of the ensemble note selected by the selector 84 is applied to a duet latch circuit 86. To the load control input L thereof is applied a duet load timing pulse DLT produced by a duet and trio note processing timing control cirucit 87.

An OR gate circuit 88 in the duet and trio note processing timing control circuit 87 is supplied with a melody change detection signal ΔUK outputted from the AND gate circuit 58 shown in FIG. 6 and a chord change detection signal ΔCH outputted from an AND gate circuit 80. As shown in FIG. 5*c*, when a melody change detection signal ΔUK or a chord change detection signal ΔCH is generated when a synchronizing signal SY is generated, the OR gate circuit 88 produces an output "1" which is used to reset the flip-flop circuit 89. The set output Q of this flip-flop circuit 89 is delayed one bit time by a delay flip-flop circit 90 and then applied to an NOR gate circuit 60 and an AND gate circuit 91 as a duet note processing timing signal DUP. When this signal DUP becomes "1" as shown in FIG. 5*e*, the output $\overline{D}\,\overline{T}$ of the NOR gate circuit 60 becomes "0" which disables the AND gate circuits 59 and 80 shown in FIG. 6 to prevent the melody change detection signal ΔUK and the chord change detection signal ΔCH from being continuously generated (also in the next cycle). Because, as two cycle times are used for processing the duet and trio notes it is necessary to prevent the change of the contents of the latch circuits 56 and 78 (FIG. 6) during this interval. Consequently, signals ΔUK and ΔCH are not generated at the time of generating a synchronizing signal SY during the next cycle in which the signal ΔUK or ΔCH is generated, so that the output of the OR gate circuit 88 shown in FIG. 7 is always "0". At this time, an AND gate circuit 92 supplied with a signal "1" produced by inverting the output "0", and the synchronizing signal SY is enabled to produce an output "1" which is used reset a flip-flop circuit 89, whereby the duet note processing time signal DUP becomes "0" one bit time after the resetting of the flip-flop circuit 89.

The other input of the AND gate circuit 91 is supplied with a synchronizing signal SY so that it is enabled at the timing 0 immediately prior to the time at which the duet note processing time signal DUP becomes "0" to produce a duet note load timing pulse DLT as shown in FIG. 5*e*.

The latch circuit 56 or 78 shown in FIG. 6 outputs a new data stored according to the change detection signal ΔUK or ΔCH in synchronism with the building up of a duet note processing time signal DUP. Consequently, the circuits shown in FIG. 7 execute processings for obtaining a new melody note or a key note number DKNO of an ensemble note corresponding to a chord following the building up to "1" of the duet note processing time signal DUP. During an interval between the building up of the signal DUP and the generation of the duet note load timing pulse DLT, 17 bit times after, the processing for obtaining the key note number DKNO of a new ensemble note has completed perfectly, and the key note number DKNO of the new ensemble note is positively latched in the latch circuit 86 by the pulse DLT.

The processing for obtaining the key note number DKNO' of an ensemble note when a chord is not formed is executed during an interval in which the duet note processing time signal DUP is being generated.

The quasi ensemble note forming circuit 48 performs, on the time division basis, the functions of the quasi ensemble note forming circuit 48 and the second ensemble note forming circuit 21 shown in FIG. 1. While a duet note processing time signal DUP is being generated, the circuit 48 executes the processing of forming the key notes number DKNO' of an ensemble note (duet) at the time of not forming a chord. This operation will firstly be described. Thus, the key note number KNO* of a melody note outputted from the latch circuit 56 shown in FIG. 6 is supplied to the A input of the selector 93, while a key note number DKNO or DKNO' of a duet note latched by the duet note latch circuit 86 is applied to the B input. A trio note processing time signal TRP is applied to the B select control input of the selector 93 SB because this signal is "0" during the duet note processing. As a consequence, during the duet note processing, the selector 93 selects the key note number KNO* of a melody note applied to its A input and the selected key note number is supplied to a subtractor 94 which subtracts 3 from the key note number KNO* given from the selector to produce a key note number representing a note, a minor third lower. Because, when a chord is not formed, a note closest to a melody note and lower than it by minor third or more is selected as an ensemble note among the chord consituting notes so that the scanning begins starting from a note, a minor third lower than the melody note.

The output of the subtractor 94 is applied to the B input of a selector 95 and a signal obtained by delaying 1 bit time the synchronizing signal SY with a delay flip-flop circuit 96 is applied to the B select control input of the selector 95. The timing of producing the key note number KNO* of a new melody note from the latch circuit 56 shown in FIG. 6 is one bit time later than the timing of the melody change detection signal ΔUK, that is the timing of the synchronizing signal SY, so that for the purpose of synchronization, the signal SY is delayed one bit time. For this reason, the output (KNO*−3) of the subtractor 94 is selected by the selector 95 through its B input and applied to a delay circuit 85 at a timing shown in FIG. 5*e*.

Each time a system clock pulse $\phi$ is applied via one input of an AND gate circuit the selector 85 delays the key note number given from a selector 95 by one bit time and outputs the delayed key note number. When the AND gate circuit 99 is disabled to block the system clock pulse $\phi$, the key note number received in the delay circuit 85 would be held as it is. The output of a flip-flop circuit 96 or a noncoincidence signal $\overline{EQ}$ outputted from a note name coincidence detector 97 is applied to the other input of the AND gate circuit 99 via an OR gate circuit 98. When the selector 95 selects the output (KON*−3) of the subtractor 94 in accordance with the output "1" of the delay flip-flop circuit 96, the and gate circuit 99 is enabled and the output (KNO*−3) of the selector 95 is applied to the delay circuit 85 and outputted therefrom one bit time later.

The key note number outputted from the delay circuit 85 is sent to a note decoder 100 and a subtractor 101. Similar to the note decoder 61 described above, the note decoder 100 decodes the key note number corresponding to 12 note names (C through B), and the output of the note decoder 100 is applied to one input of a note name coincidence detection circuit 97, the other input thereof being connected to receive data LK (C through B) representing the note names of the LK depressed keys (chord constituting notes) from the latch circuit 72 shown in FIG. 6. The note name coincidence detector 97 changes the noncoincidence signal $\overline{EQ}$ to "0" when the note name decoded by the decoder 100 coincides with the note name of either one of the LK depressed keys, but when they do not coincide with each other, it changes the noncoincidence signal $\overline{EQ}$ to "1". Thus, the noncoincidence signal $\overline{EQ}$ is held at "1" until a coincidence is detected so that the clock pulse $\phi$ is supplied to the delay circuit 85 via AND gate circuit 99.

Another subtractor 101 is provided to subtract [1] from the key note number given from the delay circuit 85 and to apply the difference to the A input of the selector 95 which becomes to a state that can selects its A input after it selects the output (KNO*−3) of the subtractor 94 so that the output of the subtractor 101 would be applied to the delay circuit 85 via the selector 95.

Accordingly, each time a clock pulse $\phi$ is generated, a loop comprising the delay circuit 85, the subtractor 101 and the selector 95 sequentially subtracts [1] from the key note number (KNO*−3) until the note name coincidence circuit 97 detects a coincidence, whereby the value of the key note number outputted from the delay circuit 85 sequentially decreases as KNO*−3, KNO*−4, KNO*−5, KNO*−6 . . . (changing toward low tone side). This timing is shown in the row of search in FIG. 5*e*.

When the value of the key note number outputted from the delay circuit 85 is lower than a melody note by a minor or more third and becomes to correspond to the note name of a chord constituting note (a lower keyboard depressed key) closest to the melody note, the note name coincidence detector 97 detects a coincidence and the noncoincidence signal EQ becomes "0". As a consequence, the clock pulse $\phi$ is blocked by the AND gate circuit 99 and the delay circuit 85 holds the key note number (that is the key note number DKNO' of an ensemble note when a chord is not formed).

The search of the key note number DKNO' completes at a time 12 bit times (at the latest) after the selector 95 has selected the output (KNO*−3) of the subtractor 94. In other words, 12 bit times is sufficient to complete a search regarding a total of 12 note names C through B. Accordingly, the processing of determining a key note number DKNO' of an ensemble note at a time when a chord is not formed while a duet processing time signal DUP is being generated. If at this time, when a chord is not formed, the key note number DKNO' is applied to latch circuit 86 via the B input of the selector 84. Consequently, the ensemble note key note number DKNO' produced when no chord is formed is surely latched in the latch circuit 86 when a duet load timing pulse DLT is generated immediately before the duet processing time signal DUP changes to "0".

The processing of a trio note will now be described. Thus, in a timing control circuit 87, a duet load timing pulse DLT produced by an AND gate circuit 91 is applied to one input of an AND gate circuit 102, the other input thereof being connected to receive the output of a trio selection switch TR-SW. When the trio selection switch TR-SW is closed, the processing for forming a trio note is executed to add a trio note. On the otherhand, when the switch TR-SW is off, the processing for forming the trio note is not executed, so that no trio note is added. When the switch TR-SW is on, the AND gate circuit 102 is enabled and a duet load timing pulse DLT is applied to the set input S of a flip-flop circuit 103 via the AND gate circuit 102. To the reset input R of the flip-flop circuit 102 is applied the output of an AND gate circuit 104 inputted with a signal formed by inverting the output of the AND gate circuit 102 and the synchronizing signal SY. Consequently, the output of the flip-flop circuit 103, or the trio processing time signal TRP becomes "1" at the time when the pulse DLT is generated as shown in FIG. 5*e*, and becomes "0" at the time when the next synchronizing signal SY is generated.

When the trio processing time signal TRP becomes "1" the selector 93 selects the key note number (DKNO or DKNO', hereinafter denoted by DKNO) of the duet note applied to its B input from the latch circuit 86. A subtractor 94 subtracts 3 from the key note number DKNO of the duet note to obtain a key note number showing a note, a minor third lower than the duet note. As above described, the selector 95 selects the output of the subtractor 94 applied to its B input, one bit time later than the synchronizing signal SY, that is one bit time later than a time at which the key note number DKNO of a new ensemble note is stored in the latch circuit 86 in accordance with a duet load timing pulse DLT. At this time, the subtractor 94 produces a value (DKNO−3) by subtracting 3 from the key note number DKNO of the new duet note.

In the same manner as the above described, a search of the key note number DKNO' for a note forming a chord is made. At first the note name of a key note number DKNO−3, a minor third lower than the duet note, is compared with each one of the note names (chord constituting notes) of the LK depressed keys, and then [1] is sequentially subtracted from the key note number DKNO−3 by a group constituted by the delay circuit 85, a subtractor 101, and a selector 95, and respective note names of the LK depressed keys are compared with each other at each comparison. When the value of the key note number outputted from the delay circuit 85 is of the same note name as a chord constituting note, and on the lower tone side than the duet note by a minor third or more, and moreover when it reaches a value representing a note closest to the duet note, the noncoincidence signal $\overline{EQ}$ outputted by the note name coincidence detector 97 becomes "0", thus completing the search. The key note number at this time is the key note number TKNO of the note to be produced and is held for a meanwhile thereafter in the delay circuit 85 (see row search shown in FIG. 5.)

The key note number TKNO of a trio note outputted from the delay circuit 85 is applied to a trio note latch circuit 105, the load control input L thereof is being supplied with a trio load timing pulse TLT from an AND gate circuit. The inputs of the AND gate circuit 106 are supplied with a signal obtained by delaying 1 bit time the trio processing time signal TRP with a flip-flop circit and a synchronizing signal SY, so that the trio load timing pulse TLT is changed to "1" immediately after the trio processing time signal TRP becomes "0" as shown in FIG. 5*e* by the timing action of the synchronizing signal SY. At this time, the search of the key note number TKNO of the trio note performed by the circuit 48 already completes, and the key note number TKNO is applied to the delay circuit 85, whereby the key note number TKNO would surely be latched in the latch circuit.

As above described, during two cycles of the channel timing immediately following the detection of the change of a melody note or a chord, the processing for determining the key note number DKNO (or DKNO') of a duet note and the key note number TKNO of a trio note is executed and these key note numbers are latched respectively in latch circits 86 and 106. During the two cycles in which the processing described above is executed, the output signal $\overline{D}\ \overline{T}$ of NOR gate circuit 60 which inverts the duet processing time signal DUP, and the trio processing time signal TRP become "0", and the AND gate circuit 58 or 80 (FIG. 6) would not produce a melody change detection signal ΔUK or a chord change detection signal ΔCH.

The outputs of the latch circuits 86 and 105 are applied to the A input and the B input of a multiplexer 108, respectively. The purpose of the multiplexer 108 is to synchronously multiplex, on the time division basis, or assign the key note numbers applied to its A and B inputs to the duet channel timing 16 and the trio channel timing 17 (see FIG. 5*a*), respectively. To the A select control input of the multiplexer 108 is supplied a duet channel timing signal DUT (see FIG. 5*b*) so that the key note number DKNO (or DKNO') of the duet note applied to the A input is selected in synchronism with the duet channel timing 16 and applied to a key code converter 109. The B select control input SB of the multiplexer 108 is supplied with the output of an AND gate circuit 110 inputted with the trio channel timing signal TRT (see FIG. 5*b*) and the output of the trio selection switch TR-SW. Consequently, only in a case wherein the switch TR-SW is closed to add a trio note, the trio channel timing signal TRT can pass through the AND gate circuit 110 so as to select the key note number TKNO of the trio note applied to the B input in synchronism with the trio channel timing 17.

The key code converter 109 converts the key note numbers of the duet note and the trio note which are applied in a time divisioned and multiplexed mode into the key codes KC shown in Table IV, because the musical tone forming circuits 33 through 35 are constructed to form musical tones corresponding to these codes. The control signal of a gate circuit 111 is ordinarily "1" so that the gate circuit 111 permits the passage of the key code DKC of the duet note and the key code TKC of the trio note outputted from the key code converter 109. An OR gate circuit 112 is provided for forming a key-on signal KON accompanied by these by codes DKC and TKC. All bits of the key codes outputted from the gate circuit 111 are applied to an OR gate circuit 112 so that the output of the OR gate circuit 112, that is the key-on signal KON becomes "1" when the duet note key code DKC has a value other than 0. In the same manner, also when the trio note key code TKC has a value other than 0 the key-on signal outputted by the OR gate circuit 112 becomes "1".

The control signal ENB of the gate circuit 111 is applied from the NOR gate circuit 113 shown in FIG. 6, and the NOR gate circuit 113 is supplied with the outputs of a NOR gate circuit 114 and an AND gate circuit 115. The NOR gate circuit 114 is supplied with the all bits of the key note number KNO* outputted from the latch circuit 56. When no key of the upper keyboard 22 is depressed, all bits of the output of the latch circuit 56 are "0", while the output of the NOR gate circuit 114 becomes "1". Then, the output "1" of the NOR gate circuit 114 is inverted by a NOR gate circuit 113 to change the control signal ENB to "0". On the other hand, the inputs of an AND gate circuit 115 are supplied with a chord not formed signal NC among the chord data latched by the latch circuit 78 and a signal obtained by inverting the 4-key-or-more signal 4 KEY with an inverter 116. When a chord is not formed (that is NC is "1") and when less than 3 keys of the lower keyboard 23 are depressed (that is signal 4 KEY is "0" and the output of the inverter 116 is "1") the output of the AND gate circuit 115 becomes "1", which is inverted by the NOR gate circuit 113, and the control signal ENB becomes "0". Then the gate circuit 111 shown in FIG. 7 is desenabled so that the key code DKC of the duet note and the key code of the trio note are blocked. Consequently, where no key of the upper keyboard 22 is depressed (that is when no melody key exists), or where the number of the chord constituting notes (LK depressed keys equal to or) is less than 3, the forming of the ensemble note is precluded. Accordingly, the key code DKC (and the key code TKC of a trio note to be added thereto) corresponding to the key note number of a duet note formed in the circuit 48 when a chord is not formed passes through the gate circuit 111 only when the number of the LK depressed key is equal to or larger than 4.

The key code DKC of a duet note, the key code TKC of a trio note, and a key-on signal KON accompanied therewith which are outputted from a gate circuit 111 are inputted to gate circuits 117, 118 and 119 of the selection gate unit 32 (FIG. 4) as the output of the ensemble note forming circuit 26. Gate circuit 120, 121 and 122 of the selection gate unit 32 are supplied with the key code KC and the key-on signal KON outputted from the depressed key detector and tone production assignor 25, on the time division basis. The outputs of the gate circuits 117 and 120 are applied to a tone source circuit 126 of the manual set type musical tone forming circuit 33 via an OR gate circuit 123, while the outputs of the gate circuits 118 and 121 are applied to the tone source circuit 128 of a percussive type musical tone forming circuit 35 via an OR gate circuit 125. The duet note key code DKC and the trio note key code TKC (and their key-on signals KON) supplied to the OR gate circuits 123 through 125 via gate circuits 117 through 119 are generated at the duet note channel timing 16 and the trio note channel timing 17 by the operation of the multiplexer 108. The key code KC and the key-on signal KON supplied from the circuit 25 to the OR gate circuits 125, 124 and 125 via the gate circuits 120 through 122 are generated at the channel timings 1 through 15 with regard to the depressed keys of the pedal keyboard, the upper keyboard and the lower keyboard put not generated at the channel timings 16 and 17. For this reason, in the OR gate circuits 123, 124 and 125, the key codes KC, DKC, TKC and the key-on signal KON of respective channel timings do not overlap each other at the same time so that these key-codes and signals are outputted in a time divisioned and multiplexed mode.

Each of the tone source circuits 126, 127 and 128 has a total of 9 musical tone producing channels, that is 7 channels for the upper keyboard, one channel for the duet note, and one channel for the trio note. Each one of the tone source circuits 126 through 128 judges respective channel timings based on the synchronizing signal SY for selecting key codes KC and key-on signals KON appearing at the upper keyboard channel timings 2 through 8 and the key codes KC, DKC, TKC and key-on signals KON inputted via OR gate circuits 123 through 125 and for selecting key codes DKC, TKC and key-on signals KON appearing at the channel timings 16 and 17 so as to convert the selected codes and signals into static states, whereby tone source signals having tone pitches corresponding to the selected key codes are outputted after being imparted with a predetermined amplitude envelope in accordance with the state ("1" or "0") of a key-on signal KON accompanied with the tone source signals. More particularly, the tone source circuits 126 through 128 for various circuits 33 through 35 are constructed to generate tone source signals for the notes (melody notes), duet note and trio note corresponding to the upper keyboard depressed keys. Actually however, the tone source signals generated by these tone source circuits 120 through 128 do not cover all of these signals but only those selected by the selection gate unit 32 are generated.

The tone source signals generated by the tone source circuits 126 through 128 corresponding to one key code KC (or DKC or TKC) is not limited to one kind, but includes a plurality of types and signals of the same type are admixed together and then outputted. In the tone volume type tone source circuit 126, tone source signals are generated for respective foot registers 4', 8' . . . having different frequencies of twice, same, half . . . Each of the tone source signals for the foot registers 4', 8' . . . has a wavefore (for example a sine waveform) containing less component of harmonics. The percussive type and the sustain type tone source circuits 127 and 128 produce tone source signals, for example tooth waveform and rectangular waveform signals containing a relatively large quantity of harmonic components and having different waveforms.

The shape of the amplitude envelopes inparted by the tone source circuits 126 and 128 of the tone volume type and the sustain type are of the sustain tone type envelope (that is an envelope which permits continuous tone production while a key is depressed, that is the key-on signal KON is "1"). The shape of the amplitude envelope imparted by the percussive type tone source circuit 127 is of the attenuating tone type, that is of the percussive type, or an envelope which alternates after a musical tone has once produced whether a depressed key is maintained in the depressed state or released.

The tone source signals (for example a sine wave) of respective footage 4', 8' . . . outputted from the tone source circuit 126 of the tone volume type musical tone forming circuit 33 are applied to a tone color setting circuit 129 which admixes together the tone source signals of 4', 8' . . . at a suitable amplitude ratio for producing various footage tone signals of various musical instrument tones, that is a 4 foot tone signal 4', a 8 foot tone signal 8' . . . of a flute, a 4 foot tone signal S4', a 8 foot tone signal S8' . . . of a string instrument, etc. Various footage tone signals F4', F8' . . . SF', S8' . . . are applied to a mixing circuit 130. Tone volumes (variable resistors) 36 are provided for respective footage note signals F4', F8' . . . S4', S8' . . . and the mixing circuit 130 mixes together these footage tone signals at an amplitude ratio (tone volume) set by the tone volume 36 and then outputs the admixed signals. The tone volume 36 can be adjusted freely by the performer. Consequently, in the tone volume type musical tone forming circuit 33, respective footage tones of a flute and a strings musical instrument imparted with the sustain tone type envelope are admixed at a suitable ratio selected by the performer with the result that it is possible to impart a tone color desired by the performer.

A tone source signal outputted from the tone source circuit 127 of the percussive type musical tone forming circuit 34 is applied to a tone filter, the characteristic thereof being varied in accordance with a parameter produced by a parameter generator 131. The parameter generator 131 is preset with parameters necessary to impart preset tone colors of the envelops for such percussive musical instruments as a piano, a banjo or the like so as to produce desired parameters corresponding to the desired preset tone colors when tone color selection switches Pf-Sw (piano), Bj-Sw (banjo) . . . are selectively operated. Tone color signals in the form of a tooth wave or a rectangular wave are filtered in accordance with the parameters so that a musical tone signal having a predetermined tone color selected by the switches Pf-SW, Bj-SW . . . is outputted from the tone filter 37.

The sustain type musical tone forming circuit 35 is also provided with a tone filter 38 and a parameter generator 132 so as to filter a tone source signal outputted from a tone source circuit 128 with a characteristic corresponding to a parameter generated by the parameter generator 132 to obtain a musical tone signal having a predetermined tone color. The parameter generator 132 of this type is preset with parameters necessary to provide an envelope for such musical instruments which produce sustain tones as an oboe, a trombone or the like, so that when tone color selection switches Ob-SW (oboe), Tr-SW (trombone) . . . are selectively operated parameters corresponding to any desired preset tone colors can be produced.

As above described, both of the percussive type and sustain type musical tone forming circuits 34 and 35 are constructed to select any desired preset tone color by operating tone color selection switches.

As above described, three musical tone forming circuits 33, 34 and 35 of the selection gate unit 32 adapted to form specific musical tones are used to independently select any one of the UK depressed key notes (a melody note) and an ensemble note (duet note and trio note). The operation of the gate circuits 117 through 122 are independently controlled by the ON and OFF states of corresponding switches DS1 through DS3 and MS1 through MS3. Melody selection switches MS1, MS2 and MS3 independently select whether the UK depressed note (melody note) are to be formed by respective musical tone forming circuits 33, 34 and 35 or not, and the gate circuits 120, 121 and 122 are enabled when switches MS1, MS2 and MS3 corresponding thereto are closed. Consequently, only to the tone source circuits corresponding to gate circuits 120, 121 and 122 enabled by the switches SMl through MS2 are applied the key codes KC and key-on signals KON of the UK depressed keys, whereby only one or more of the circuits 33, 34, 35 selected by the melody selection switches MS1, MS2 and MS3 generate the upper keyboard depressed key note, that is a melody note.

Duet selection switches DS1 through DS3 are provided for the purpose of independently selecting whether a duet note musical signal is to be formed with one or more musical tone forming circuits 33, 34 and 35. A switch D-SW is connected to the common junction of the duet selection switches for determining whether the electronic musical instrument provides a duet performance effect or not. For enabling ready selection of the duet note during the keyboard performance, it is advantageous to construct the switch D-SW as a knee lever switch. When the switch D-SW is closed a signal "1" is applied to the common juncture of the duet selection switches DS1 through DS3, whereas when this switch is open the signal "1" would not be applied to the duet selection switches DS1 through DS3 so that not duet note would be added irrespective of whether the switches DS1 through DS3 are on or off.

When the switches DS1 through DS3 are closed while the switch D-SW is being closed, one or more gate circuits 117 through 119 are enabled corresponding to the closed switches so as to apply the duet note key codes DKC, the trio note key code TKC and the key-on signals KON accompanied therewith only to the tone source circuits 126, 127 and 128 corresponding to the enabled gate circuits 117 through 119. As a consequence, circuits 33, 34, 35 selected by the duet selection switches DS1 through DS3 produces duet notes (duet note and trio note).

Thus, the performer can produce a musical tone having a tone color comprising any combination of a melody note and a duet note by suitably combining three musical tone forming circuits 33, 34 and 35 which form musical tones with different methods.

Figure 8:
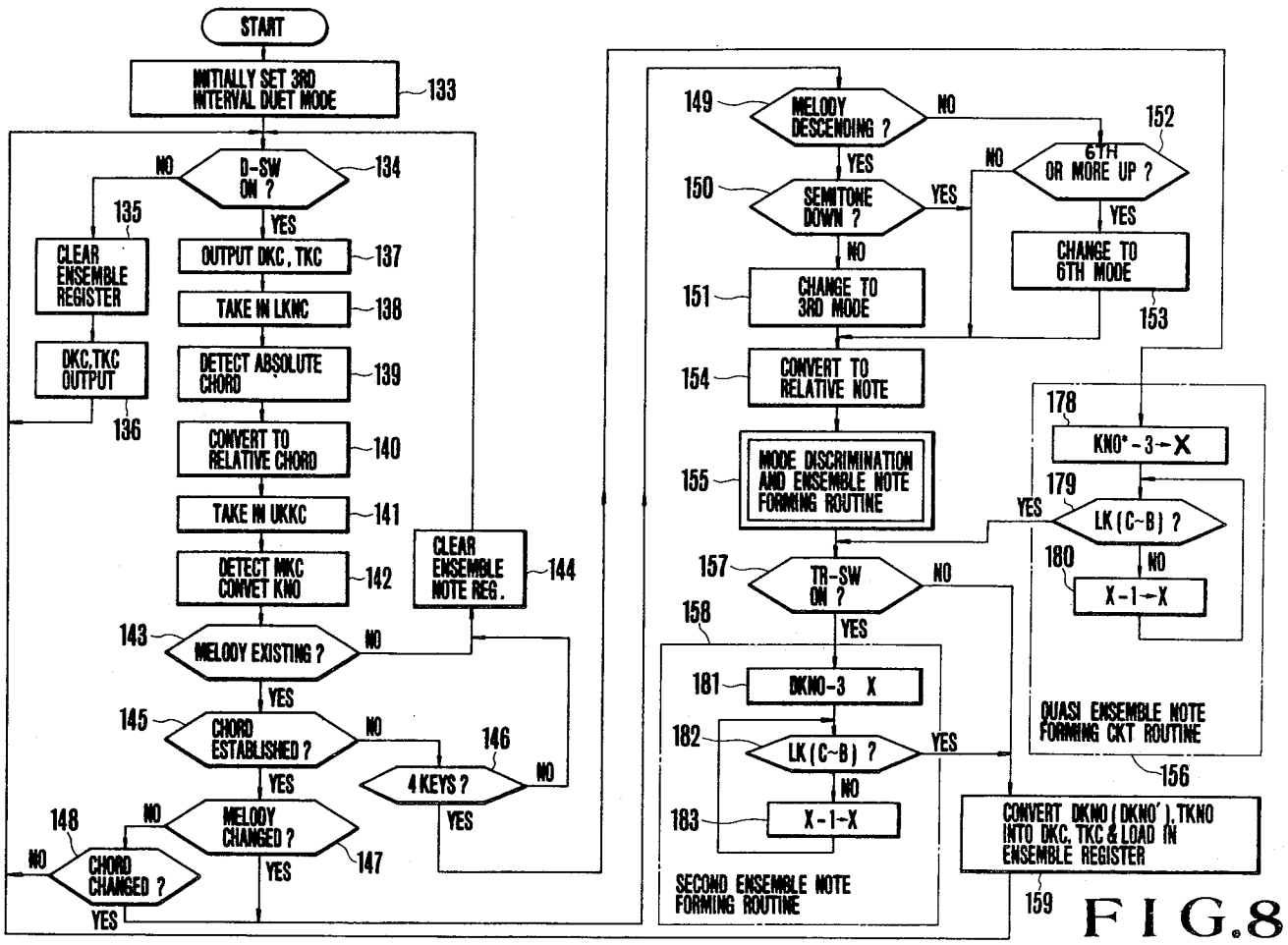
FIG. 8 is a flow chart of a program where the ensemble note forming circuit shown in FIG. 4 is constituted by such conventional device as a microcomputer.
Figure 9:
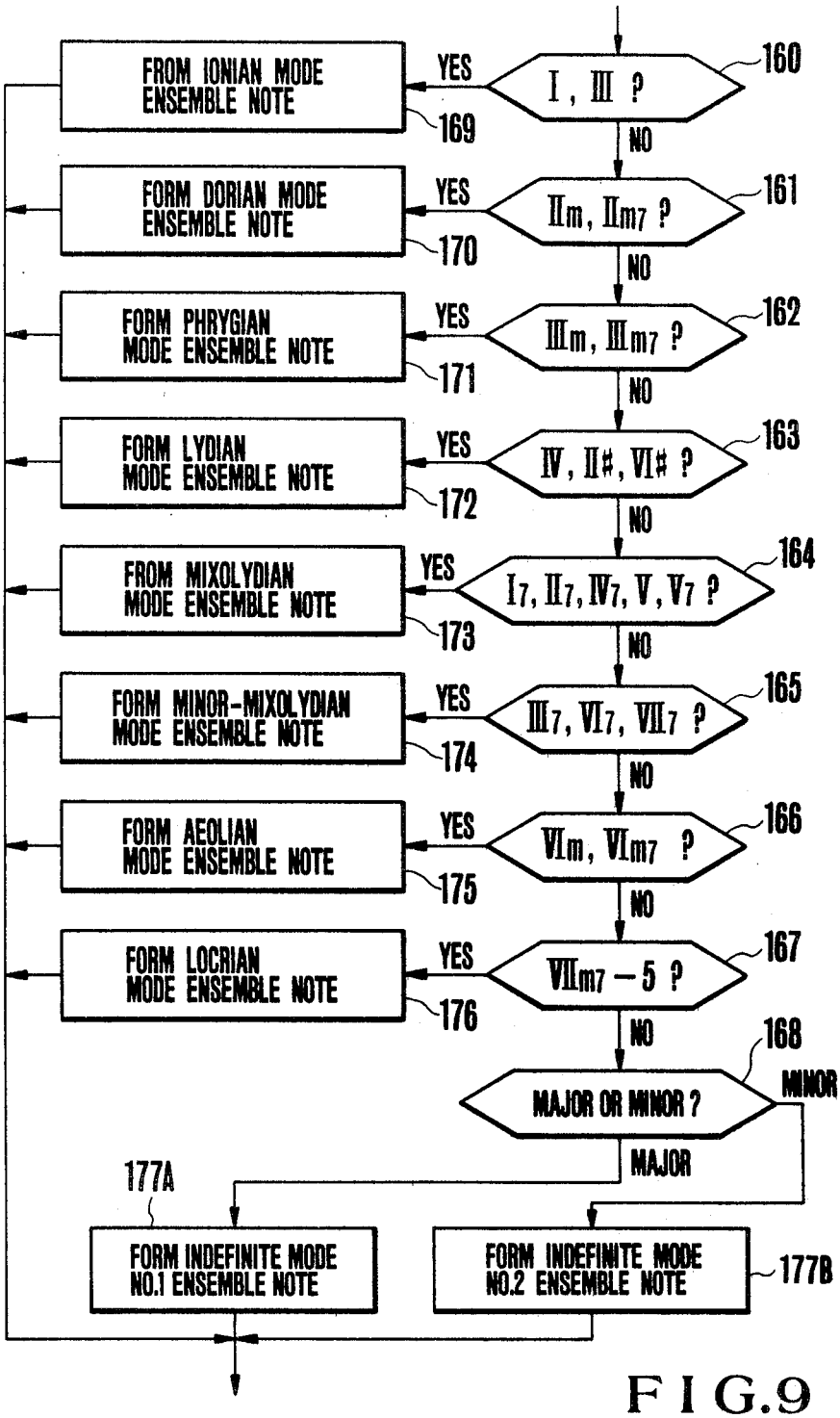
FIG. 9 is a flow chart showing the outline of the scale or melody mode descrimination routine and an ensemble note forming routine.

Although FIGS. 6 and 7 illustrate an example in which the duet forming circuit 26 is made up of discrete circuits, it is possible to constitute the circuit 26 with a microcomputer, in which case, the signals may be processed according to the procedures shown in FIGS. 8 and 9. FIGS. 8 and 9 show flow charts of a program for forming the key codes DKC and TKC of a duet note (duet note and a trio note) executed by the circuits shown in FIGS. 6 and 7. The contents of the processings executed at respective steps can be readily understood from the foregoing description so that FIGS. 8 and 9 will be described only briefly. Symbols of the signals are the same as those used in FIGS. 6 and 7.

More particularly, at step 133 immediately following the start, the interval mode of a duet note is initially set to the third mode. At the next step 134, a judgment is made whether the duet selection switch D-SW (see FIG. 4) is on or off. When the result of judgments is NO, the processings of the steps 135 and 136 are repeatedly executed to clear to [0] the contents of the duet note key code DKC and the trio note key code TKC stored in a ensemble register, not shown, for applying the cleared contents to a musical tone forming circuit, not shown (for example to the selection gate unit 32 and the musical tone forming circuits 33, 34 and 35 shown in FIG. 4). In this case since the contents of the key codes DKC and TKC are [0], no duet note is produced. On the other hand, when the result of the judgment is YES, the processings at step 37 and following steps are executed. The key codes DKC and TKC outputted at this step 137 are those loaded in the ensemble register at the last step 159.

At step 138, a note code LKLC of the lower keyboard depressed keys is taken in, and at step 139 an absolute chord is detected based on the note code LKNC to determine various chord data latched in the latch circit 73 shown in FIG. 6. At step 140, the absolute chord is converted into a relative chord R C. At step 141, the key code UKKC of the upper keyboard depressed keys is taken in. At step 142, the key code MKC of the UK highest note depressed key is detected based on the key code UKKC, and the detected key code is converted into a key note number KNO.

At step 143, a judgment is made as to whether keys producing a melody note are depressed or not. (is there a code MKC). When the result of judgment is NO, the program is advanced to step 144 to clear the ensemble register, thus returning to the step 132. On the other hand, when the result is YES, at step 145 a judgement is made whether a chord is formed or not. When the result of judgment executed at step 145 is NO, at step 146, a judgment is made as to whether the number of depressed keys of the lower keyboard is equal to or larger than 4 or not. When the result of the judgment is YES, the program is transferred to a chord-not-formed duet forming routine 156.

Where the chord is formed, at step 147, a judgment is made as to whether a chord has changed or not. At step 149 a judgment is made as to whether a melody note has been lowered than a previous note. At step 150 a judgment is made as to whether a melody note is lower than the preceding note by a semitone or not (is lower by a whole tone or more). At step 152, a judgment is made as to whether a melody note is higher than a preceding note by 6th or more or not. According to the result of judgment executed at step 152 or 150, the fact that a condition for switching to the 6th or third mode has been satisfied or not is detected, and when this fact is detected at step 153 or 151, the interval mode is switched to the 6th mode or the third mode.

At step 154, a melody note is converted into a relative note. In a melody mode and an ensemble note forming routine 155 the melody mode is judged according to the relative chord to form a key note number of an ensemble (duet note) based on the melody mode and the relative note of the melody. The detail of this routine 155 is shown in FIG. 9. More particularly, at steps 160 through 169, the melody mode descrimination table shown in Table I is executed during the program flow (that is without providing any special ROM corresponding to the table). Thus, the melody mode is discriminated by sequentially checking whether the present relative chord corresponds to I through VIIm7-5 or not. When the result of judgment at step 167 is NO, it means a not clear mode and at the next step 168, a judgment is made as to whether the relative chord is a major chord or a minor chord. In the ensemble note forming routines 169 through 177B corresponding to respective melody modes, processings are executed similar to those executed by the duet interval data table 45, selector 46 and subtractor 47 shown in FIG. 7. More particularly, the 3rd or 6th mode interval data $\Delta D(3)$ or $\Delta D(6)$ corresponding to the relative note of a given melody mode is determined and then the determined value is subtracted from the key note number KNO* of a melody note to determine the key note number DKNO of the ensemble note.

Returning back to FIG. 8, in the ensemble note forming routine 156 which is used when a chord is not formed, at step 178, 3 is subtracted from the key note number KNO* of a melody note, and the difference is stored in a register X. At step 179, the note name of the key note number stored in the register X is compared with all the note names LK (C through B) of the LK depressed keys to judge whether there is a coincident note name or not. When the result of judgment is NO, at step 179 1 is subtracted from the content of the register X and then the program is returned to step 179. In this manner, 1 is sequentially subtracted from (KNO* − 3) until a coincidence is detected. Upon detection of the coincidence of the note names, the register X holds a key note number DKNO' on the lower tone side than the melody note by more than a minor third having the same note name as either one of the chord constituting notes (LK depressed keys) and showing a note closest to the melody note.

At step 156, a judgment is made as to whether the trio selection switch TR-SW is closed or not. When the result of judgment is YES, after executing the second ensemble note forming routine, the program is advanced to step 159, whereas when the result is NO, the program is transferred to step 159 by jumping over the routine 158. In the second ensemble note forming loop 158, 3 is subtracted from the key note number DKNO or DKNO' of the ensemble note determined in the routine 155 or 156. Then at steps 182 and 183, the same processings as at steps 179 and 180 are executed. In this manner, a note is selected as a trio note which is on the lower note side than the ensemble note by more than a minor third, having the same 13te name as either one of the chord constituting notes (LK depressed keys) and is most closest to the duet note, thereby obtaining the key note number thereof.

At step 159, the key note number DKNO or DKNO' of a duet note determined in the routine 155 or 156, and the key note number TKNO of a trio note determined in the routine 158 are converted into key codes DKC and TKC respectively and these keycodes an loaded in the duet note register.

The melody modes discriminated by the electronic musical instrument is not limited to Ionia, Doria etc. described above, and other melody modes can also be discriminated. For example, the means for performing an accompaniment chord is not limited to a keyboard, but may be button switches or the like.

It should also be understood that the method of forming a first ensemble note is not limited to that illustrated in the foregoing embodiment (that is a method wherein an ensemble note is added according to a melody mode), and that other suitable methods can also used. For example, a method according to which a first ensemble note is prepared by successively shifting a melody note by a constant note interval, a method disclosed in the aforementioned U.S. patent application wherein an ensemble note is added by taking into consideration a tonality or a tonality and a chord, or a method wherein a melody note and a tone color distribution are switched as in this invention.

As above described, since according to this invention, the melody mode now being performed is automatically judged as to whether an ensemble note suitable for the melody mode is to be added to a melody note, it is possible to perform an ensemble note performance rich is musicality.

Furthermore, according to this invention, since the tone color distribution among the depressed key notes (melody note) and an ensemble note added to the depressed key notes are switched as desired, it is possible to increase the freedom of the ensemble note performance. Accordingly it is possible to readily obtain the same ensemble performance that can be obtained with a plurality of musical instruments.

Furthermore, according to this invention, since an ensemble note preferable from the point of view of the musical theory is added, and since the second ensemble note to be added to the first ensemble note is selected to be the same note as that of either one of the accompaniment notes it is possible to produce, as musical tones, a plurality of ensemble notes without imparing harmony between the accompaniment note and the ensemble notes.

Moreover, since the melodic interval of the ensemble notes is limited within a certain amount even when the melody notes move greatly, the melodic motion of the ensemble notes is made smooth thereby performing excellent ensemble note performance.

What is claimed is:

1. An electronic musical instrument having an automatic ensemble note function based on a scale mode, comprising (a) a keyboard for performing a melody;

(b) chord performing means for performing accompaniment chords;

(c) tonality designating means for designating a tonality of a music to be performed;

(d) scale mode judging means for judging the scale mode of the music being played based on the designated tonality and the accompaniment chord;

(e) ensemble note data forming means for forming ensemble note data determined in accordance with the judged scale mode and depressed melody keys of said keyboard; and (f) musical tone forming means for forming musical tones corresponding to said ensemble note data and musical tones corresponding to said melody keys.

2. An electronic musical instrument according to claim 1 wherein said ensemble note data forming means forms ensemble note data of a tone pitch spaced from said melody key by a note interval determined by said melody key and said scale mode.

3. An electronic musical instrument according to claim 1 wherein said scale mode judging means comprises a chord detector that detects an absolute chord name of the chord peformed by said chord performing means, chord represention conversion means that converts said absolute chord name into a relative chord name with respect to a prime note of the designated a tonality, and scale mode judging means for judging a scale mode based on said relative chord name.

4. An electronic musical instrument according to claim 3 wherein said scale mode judging means includes a table in which is preset a relation between various types of the relative chords and a plurality of scale modes corresponding to the relative chords, whereby a scale mode corresponding to a relative chord obtained with said chord converting means is derived out from said table.

5. An electronic musical instrument according to claim 1 or 2 wherein said ensemble data forming means forms ensemble note data having a tone pitch spaced from a depressed key note by a note interval predetermined according to a position of said depressed key note on a note scale of said judged scale mode.

6. An electronic musical instrument according to claim 5 wherein said ensemble note forming means comprises a table in which note interval degrees for ensemble notes preferred to respective scale notes of various types of melody modes are predetermined, means for deriving out an note interval degree from said table in accordance with said judged scale mode and a position of said depressed key note on a note scale of said melody mode, and means for determining ensemble note data having a tone pitch spaced from said depressed key note by said note interval degree.

7. An electronic musical instrument according to claim 1 wherein said ensemble note forming means comprises relative note converting means for converting a note name of said depressed key of said keyboard into a relative note with reference to a root note of a chord performed with said chord performing means, interval data generating means for generating interval data representing a predetermined note interval in accordance with said relative note and said judged melody note, and arithmetic means for calculating ensemble note data having a tone pitch spaced from said depressed key note by a note interval corresponding to said interval data based on data representing said depressed key note and said interval data.

8. An electronic musical instrument according to claim 7 wherein said interval data generating means comprises a table in which values of interval data corresponding to various types of relative notes for various types of melody modes are preset and means for deriving out from said table predetermined interval data corresponding to said relative note produced by said relative note converting means and said judged scale mode.

9. An electronic musical instrument according to claim 1 wherein said chord performing means utilizes a keyboard.

10. An electronic musical instrument according to claim 1 wherein said ensemble note forming means further comprises means for forming a second ensemble note having the same note name as that of one of the notes performed by said chord performing means, said second ensemble note having a predetermined note interval relation with said first mentioned ensemble note.

11. An electronic musical instrument according to claim 10 wherein said second ensemble note forming means forms said second ensemble note having the same note name as that of either one of the notes performed by said performing means, said second ensemble note being spaced from said first ensemble note by more than a predetermined note interval and closest to said first ensemble note.

12. An electronic musical instrument having an automatic ensemble note function comprising:

a keyboard;

accompaniment note performing means;

means for forming a first ensemble note having a predetermined note interval difference with respect to a note of a depressed key of said keyboard;

means for forming a second ensemble note having the same note name as that of one of a plurality of notes performed by said accompaniment note performing means by comparing successive scale note names with the note names of said performed notes to determine coincidence therebetween, said successive scale note names beginning from a scale note having a certain note interval relation with respect to said first ensemble note, said first ensemble note forming means controlling said predetermined note interval of said first ensemble note with respect to said depressed key note in accordance with a chord performed by said accompaniment note performing means thereby producing, as a musical tone, said first and second ensemble notes together with said depressed key note.

13. An electronic musical instrument according to claim 1 wherein said musical tone forming means comprises a plurality of musical tone forming circuits for forming musical tones with different tonal characteristics, and a selector, said plurality of musical tone forming circuits forming a musical tone signal constituted by said depressed key note and said ensemble note in accordance with a combination of said circuits selected by said selector.

14. An electronic musical instrument according to claim 13 wherein said plurality of musical tone forming circuits comprise a plurality of adjustable type musical tone forming circuits capable of synthesizing a desired tone color by combining plural different tone source signals in accordance with the settings of a plurality of relative amplitude adjusting controls, and a plurality of preset type musical tone forming circuits capable of forming a musical tone having a preset tone color, said musical tone being selected from a plurality of preset tone colors.

15. An electronic musical instrument according to claim 13 wherein said plurality of musical tone forming circuits comprise a plurality of musical tone forming circuits for forming a musical tone imparted with a decaying amplitude envelope, and another plurality of musical tone forming circuits for forming a musical tone imparted with a sustaining amplitude envelope.

16. An electronic musical instrument having an automatic ensemble note function based on a scale note, comprising:

(a) a keyboard for performing a melody;

(b) means for detecting the melodic interval between successive melody notes played by successive depression of melody keys of said keyboard;

(c) means for forming ensemble note data spaced from the latter of said successively performed melody notes by a predetermined note interval determined by an output of said detecting means; and (d) means for forming musical tones including a musical tone corresponding to an output of said ensemble note data forming means, and another musical tone corresponding to said melody keys.

17. An electronic musical instrument according to claim 16 wherein said ensemble note forming means comprises means for forming a plurality of ensemble note data spaced from melody key notes by a predetermined note interval, and means for selecting one of said ensemble notes in accordance with an output of said detecting means.

18. An electronic musical instrument according to claim 17 wherein said detecting means detects the fact that a melodic note interval has varied more than a predetermined degree.

19. An electronic musical instrument according to claim 16 wherein said ensemble note data forming means comprises means for forming ensemble note data spaced from the melody note by three degrees, and means for forming ensemble note data spaced from the melody note by six degrees.

20. An electronic musical instrument according to claim 16 wherein said ensemble note forming means comprises chord performing means for performing accompaniment chord, means for designating a tonality, and an ensemble note data forming means having a tone pitch spaced from a key depressed note by a note interval determined in accordance with the designated tonality, the performed accompaniment chord, a depressed key note and an output of said detecting means.

21. An electronic musical instrument comprising:

a keyboard including keys capable of playing a note at a time;

accompaniment note performing means capable of performing plural notes at a time for accompaniment performance;

means for forming a first ensemble note having a first note interval difference with respect to a note played by a depressed key of said keyboard;

means for providing a note interval relation to define an available interval relation for a second ensemble note; and means for forming a second ensemble note having the same note name as that of one of the notes performed by said accompaniment note performing means and having a note interval relation satisfying said available interval relation with respect to said first ensemble note;

said first ensemble note forming means controlling the note interval difference of said first ensemble note with respect to the note of said depressed key in accordance with said plural notes simultaneously performed by said accompaniment note performing means;

thereby producing, as musical tones, said first and second ensemble notes together with the note of said depressed key.

* * * * *